US012611054B2

(12) United States Patent
Au et al.

(10) Patent No.: US 12,611,054 B2
(45) Date of Patent: Apr. 28, 2026

(54) GONDOLA SHELVING UNIT

(71) Applicant: B-O-F CORPORATION, Aurora, IL (US)

(72) Inventors: Derek Au, Aurora, IL (US); Howard Topping, Barrington, IL (US)

(73) Assignee: B-O-F CORPORATION, Aurora, IL (US)

( * ) Notice: Subject to any disclaimer, the term of this patent is extended or adjusted under 35 U.S.C. 154(b) by 0 days.

(21) Appl. No.: 18/947,180

(22) Filed: Nov. 14, 2024

(65) Prior Publication Data

US 2025/0160542 A1 May 22, 2025

Related U.S. Application Data

(60) Provisional application No. 63/600,622, filed on Nov. 17, 2023.

(51) Int. Cl.

| | |
|---|---|
| ***A47F 5/00*** | (2006.01) |
| ***A47B 57/34*** | (2006.01) |
| ***A47B 96/06*** | (2006.01) |
| ***A47F 5/10*** | (2006.01) |
| *A47B 47/00* | (2006.01) |
| *A47B 47/02* | (2006.01) |
| *A47B 57/06* | (2006.01) |
| *A47B 57/16* | (2006.01) |

(52) U.S. Cl.

CPC ..... *A47F 5/0018* (2013.01); *A47B 57/34* (2013.01); *A47B 96/06* (2013.01); *A47F 5/101* (2013.01); *A47B 47/00* (2013.01); *A47B 47/021* (2013.01); *A47B 57/06* (2013.01); *A47B 57/16* (2013.01)

(58) Field of Classification Search

CPC ..... A47F 5/0018; A47F 5/101; A47B 57/34; A47B 96/06; A47B 47/00; A47B 47/0058; A47B 47/021; A47B 47/024; A47B 47/027; A47B 47/028; A47B 57/06; A47B 57/08; A47B 57/10; A47B 57/16; A47B 57/30; A47B 57/32; A47B 57/40

See application file for complete search history.

(56) References Cited

U.S. PATENT DOCUMENTS 3,142,386 A * 7/1964 Skubic ..... A47B 57/402 211/182
3,272,345 A * 9/1966 Wallace ..... A47F 7/175 211/44

(Continued)

*Primary Examiner* — Devin K Barnett
(74) *Attorney, Agent, or Firm* — MARSHALL, GERSTEIN & BORUN LLP

(57) ABSTRACT

A gondola shelving unit including a first upright having a first central channel and a first front tube rigidly secured to the first central channel, the first front tube including first angled slots. The gondola shelving unit also includes a second upright having a second central channel and a second front tube rigidly secured to the second central channel, the second front tube including second angled slots. The gondola shelving unit further includes a sway brace including first teeth disposed on a first side of the sway brace and second teeth disposed on a second side of the sway brace, opposite the first side, the sway brace removably coupling the first and second uprights when the first teeth engage the first angled slots and the second teeth engage the second angled slots. The gondola shelving unit can support weight when the sway brace removably couples the first and second uprights.

3 Claims, 23 Drawing Sheets

(56) References Cited

U.S. PATENT DOCUMENTS 3,537,596 A * 11/1970 Brunette ..... A47F 5/01 211/186
3,598,066 A * 8/1971 Polezoes ..... A47F 5/103 108/157.13
3,830,374 A * 8/1974 Kassimir ..... A47F 5/103 211/1
4,018,340 A * 4/1977 Gold ..... A47F 7/175 211/44
4,035,941 A * 7/1977 Deffner ..... G09F 27/00 D6/675
4,055,253 A * 10/1977 Oztekin ..... A47F 5/103 108/108
4,093,078 A * 6/1978 Radek ..... A47F 5/103 211/189
4,377,241 A * 3/1983 Schreiner ..... A47F 5/0025 108/55.1
4,380,298 A * 4/1983 Harig ..... F16B 2/241 403/245
4,444,322 A * 4/1984 Lee ..... A47F 5/13 211/175
4,925,038 A * 5/1990 Gajewski ..... A47F 5/0018 211/128.1
5,012,938 A * 5/1991 King ..... A47B 57/18 211/182
5,069,263 A * 12/1991 Edwards ..... A47G 5/00 52/36.6
D336,183 S * 6/1993 Klein, III ..... D6/683.1
D370,367 S * 6/1996 Cassier ..... D6/676
5,605,239 A * 2/1997 DeVoursney ..... B65G 1/02 428/595
5,607,068 A * 3/1997 Coretti, Jr. ..... A47F 5/135 211/59.2
5,611,442 A * 3/1997 Howard ..... A47F 5/101 211/187
5,653,349 A * 8/1997 Dana ..... F16B 12/34 248/221.12
5,899,035 A * 5/1999 Waalkes ..... E04B 2/7433 248/245
5,918,750 A * 7/1999 Jackson ..... A47F 5/0807 108/108
6,164,467 A * 12/2000 DePottey ..... A47F 5/0846 52/36.5
6,223,916 B1 * 5/2001 Enos ..... A47B 57/408 248/242
6,240,687 B1 * 6/2001 Chong ..... A47B 13/06 312/265.2
6,394,267 B1 * 5/2002 Craig ..... B65D 88/528 206/499
D474,350 S * 5/2003 Sardis ..... D6/681.1
6,644,484 B1 * 11/2003 Sardis ..... A47F 5/137 211/189
6,669,037 B1 * 12/2003 Ahn ..... A47F 5/137 211/189
6,935,523 B2 * 8/2005 Ahn ..... A47F 5/137 211/195
7,007,815 B2 * 3/2006 Anderson ..... A47B 47/027 211/183
D544,730 S * 6/2007 Stukenberg ..... D6/703
D602,713 S * 10/2009 Stukenberg ..... D6/681.1
8,028,846 B2 * 10/2011 Peota ..... F16B 12/50 211/187
8,297,450 B2 * 10/2012 Zavidniak ..... H05K 7/183 211/13.1
8,807,356 B2 * 8/2014 Weigand ..... A47F 5/10 211/183
8,959,813 B2 * 2/2015 Denby ..... G09F 15/0068 40/606.03
9,119,487 B2 * 9/2015 Angvall ..... G09F 7/18
9,131,788 B2 * 9/2015 Lindblom ..... A47F 5/105
D785,381 S * 5/2017 Johnson ..... D6/681
D955,083 S * 6/2022 Au ..... D34/21
D972,804 S * 12/2022 Au ..... D34/21
11,576,503 B2 * 2/2023 Johnson ..... A47F 3/004
2003/0034320 A1 * 2/2003 Noh ..... A47F 5/10 211/175
2003/0127407 A1 * 7/2003 Gruber ..... A47B 47/027 211/189
2004/0045921 A1 * 3/2004 Muller ..... A47B 87/005 211/187
2004/0238470 A1 * 12/2004 Wishart ..... A47B 57/58 211/175
2006/0118504 A1 * 6/2006 Willemsen ..... B65D 90/0053 211/189
2007/0267375 A1 * 11/2007 Battaglia ..... A47B 47/03 211/189
2008/0290057 A1 * 11/2008 Zupancich, Sr. ..... B65G 1/02 211/134
2013/0146553 A1 * 6/2013 Preidt ..... A47F 5/137 211/153
2016/0007738 A1 * 1/2016 Garcia ..... A47B 55/02 29/897.312

* cited by examiner

GONDOLA SHELVING UNIT

CROSS-REFERENCE TO RELATED APPLICATION

The benefit under 35 U.S.C. § 119(e) of U.S. Provisional Patent Application No. 63/600,622, filed Nov. 17, 2023, is claimed and the entire disclosure thereof is hereby incorporated by reference.

FIELD

The present disclosure relates to shelving assemblies and, more particularly, to retail, gondola-style shelving.

BACKGROUND

Retail shelving typically provides a frame with sufficient rigidity to hold various products on display for sale. As a result, the retail shelving needs to be stable while storing a large number of products. Additionally, the retail shelving needs to be strong because the products may be heavy. Accordingly, the retail shelving includes a frame with sufficient strength and rigidity to store the large volume and weight of the aforementioned products, as well as stresses induced during restocking and consumer withdrawal of products from the shelving.

The typical retail shelving unit includes various horizontal and vertical components. The horizontal and vertical components are typically fastened together using various fasteners (e.g., bolts). As a result, employees assembling new retail shelving require various tools and complicated assembly procedures. Further, in many such examples, much of the shelving strength is provided from, and depends upon, the fasteners securely fastening components together.

SUMMARY

Disclosed herein is a gondola shelving unit. The gondola shelving unit including a first upright having a first central channel and a first front tube rigidly secured to the first central channel, the first front tube including first angled slots. The gondola shelving unit also includes a second upright having a second central channel and a second front tube rigidly secured to the second central channel, the second front tube including second angled slots. Further, the gondola shelving unit includes a front sway brace including first teeth disposed on a first side of the front sway brace and second teeth disposed on a second side of the front sway brace, opposite the first side, the front sway brace removably coupling the first upright and the second upright when the first teeth engage the first angled slots and the second teeth engage the second angled slots. The gondola shelving unit being able to support weight when the front sway brace removably couples the first and second uprights.

In some variations, the first upright includes at least one horizontal strut fixedly secured to the central channel and the front tube. In some examples, the first teeth and the second teeth are angled to correspond to the first angled slots and the second angled slots, respectively.

In other variations, the gondola shelving unit also includes a toe-kick releasably secured to the first and second uprights. In such variations, the releasable toe-kick includes a first and second tab clearance fit in slots disposed on the first and second uprights, respectively. Additionally or alternatively, the gondola shelving unit also includes a horizontal channel coupled to the central channel of the first and second uprights adjacent the top end. In such examples, the horizontal channel includes a platform and a removable cover enclosing the platform.

In yet other variations, the gondola shelving unit includes a side panel including at least one tensioned bracket, the side panel removably coupled to one of the first and second uprights via the tensioned bracket. In some such variations, the central channel includes a plurality of slots facing the front tube, each slot adapted to receive an L-tooth. Additionally or alternatively, each central channel of the first and second uprights include an inwardly directed channel, the inwardly directed channels cooperatively securing a panel perpendicular to the plurality of slots disposed on each of the central channels. In some such examples, the inwardly directed channels comprise U-channels.

Also disclosed herein is a method of assembling a gondola shelving unit. The method includes positioning a first upright, the first upright including a first central channel and a first front tube including first angled slots, the first front tube securely fixed to the first central channel. The method also includes positioning a second upright separate from the first upright, the second upright including a second central channel and a second front tube including second angled slots, the second front tube securely fixed to the second central channel. The method further includes removably coupling a first upright and a second upright with a front sway brace including first teeth and second teeth, the first teeth engaging the first angled slots and the second teeth engaging the second angled slots. The gondola shelving unit being able to support weight when the front sway brace couples the first and second uprights.

In some variations, the method also includes coupling a horizontal channel to a top end of each of the first and second uprights.

Additionally, in other variations, the method may include coupling a toe-kick to the first and second uprights via first and second tabs clearance fit in slots disposed on the first and second uprights. The method may also include coupling a side panel to one of the first and second uprights, wherein coupling the side panel to one of the first and second uprights includes securing a tensioned bracket disposed on the side panel in a slot disposed on one of the first and second uprights.

In other variations, the method includes coupling a shelf, having L-teeth, to each central channel of the first and second uprights, wherein coupling the shelf includes coupling the L-teeth in slots disposed in a first direction on the first and second uprights. In some such variations, the method also includes removably coupling a panel to the first and second uprights, the panel held in inwardly directed channels facing each other and disposed on the central channel of each of the first and second uprights. For example, holding the panel in inwardly directed channels includes sliding the panel into U-channels.

The method may also include releasably securing a toe-kick to each of the first and second uprights. Releasably securing the toe-kick to the first and second uprights may include disposing a first and second tab, disposed on the toe-kick, clearance fit in slots disposed on the first and second uprights.

BRIEF DESCRIPTION OF THE DRAWINGS

The present disclosure is described in the following detailed description in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
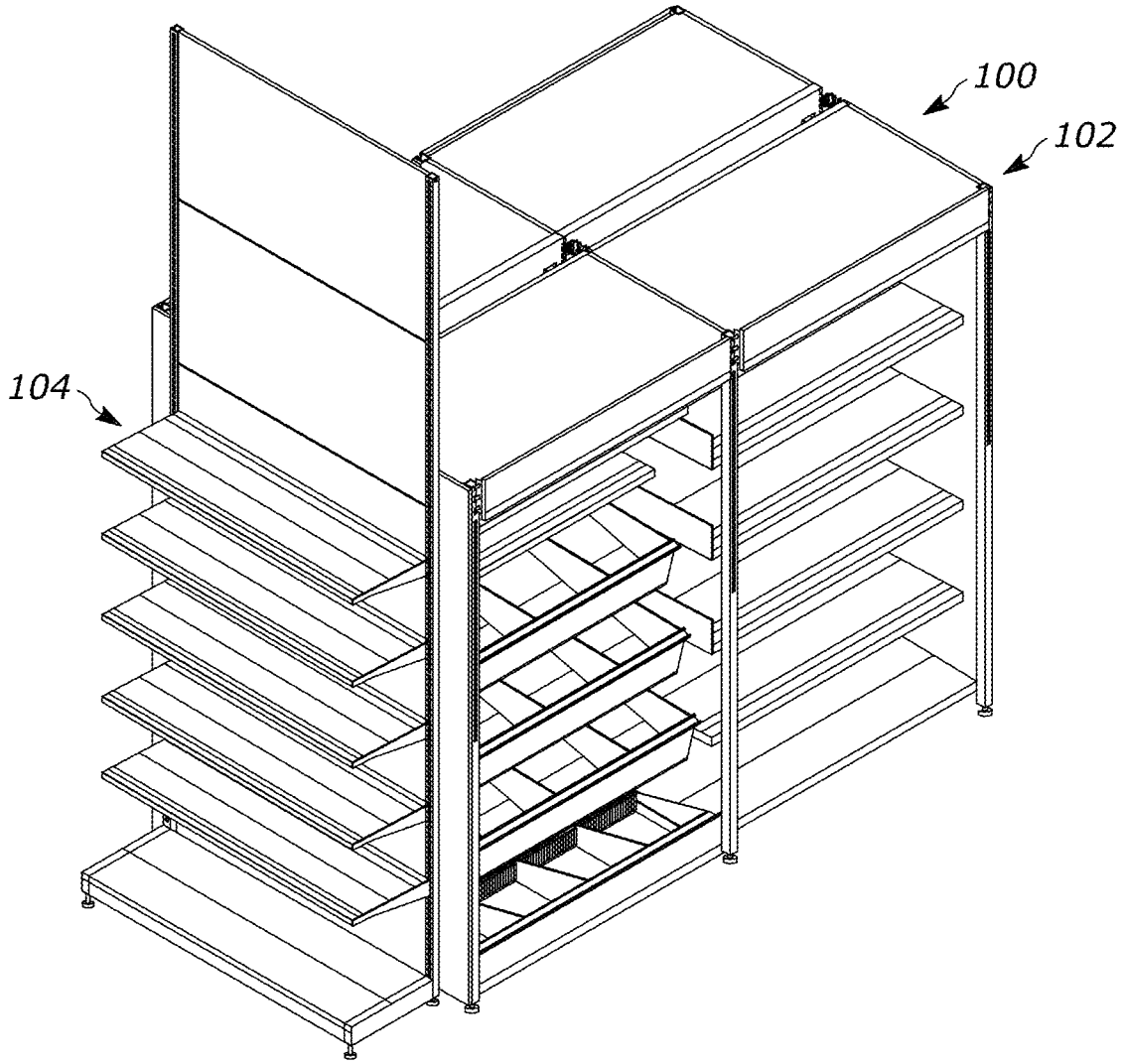
FIG. 1 is a perspective view of a gondola shelving assembly made in accordance with the present disclosure.

FIG. 1 is a perspective view of a gondola shelving assembly 100 made in accordance with the present disclosure. The gondola shelving assembly 100 includes a plurality of gondola shelving units 102 and an end cap shelving unit 104. All of the gondola shelving units 102 and the end cap shelving unit 104 include shelves for storing and displaying physical goods. As illustrated in FIG. 1, the gondola shelving assembly 100 may include various types of shelves for storing and displaying products. As further illustrated in FIG. 1, the gondola shelving assembly 100 includes two gondola shelving units 102, but may include more or fewer gondola shelving units 102. FIGS. 2-24 illustrate the steps of an example method of assembling the gondola shelving assembly 100, and provide detail as to various components of the gondola shelving assembly 100.

Figure 2:
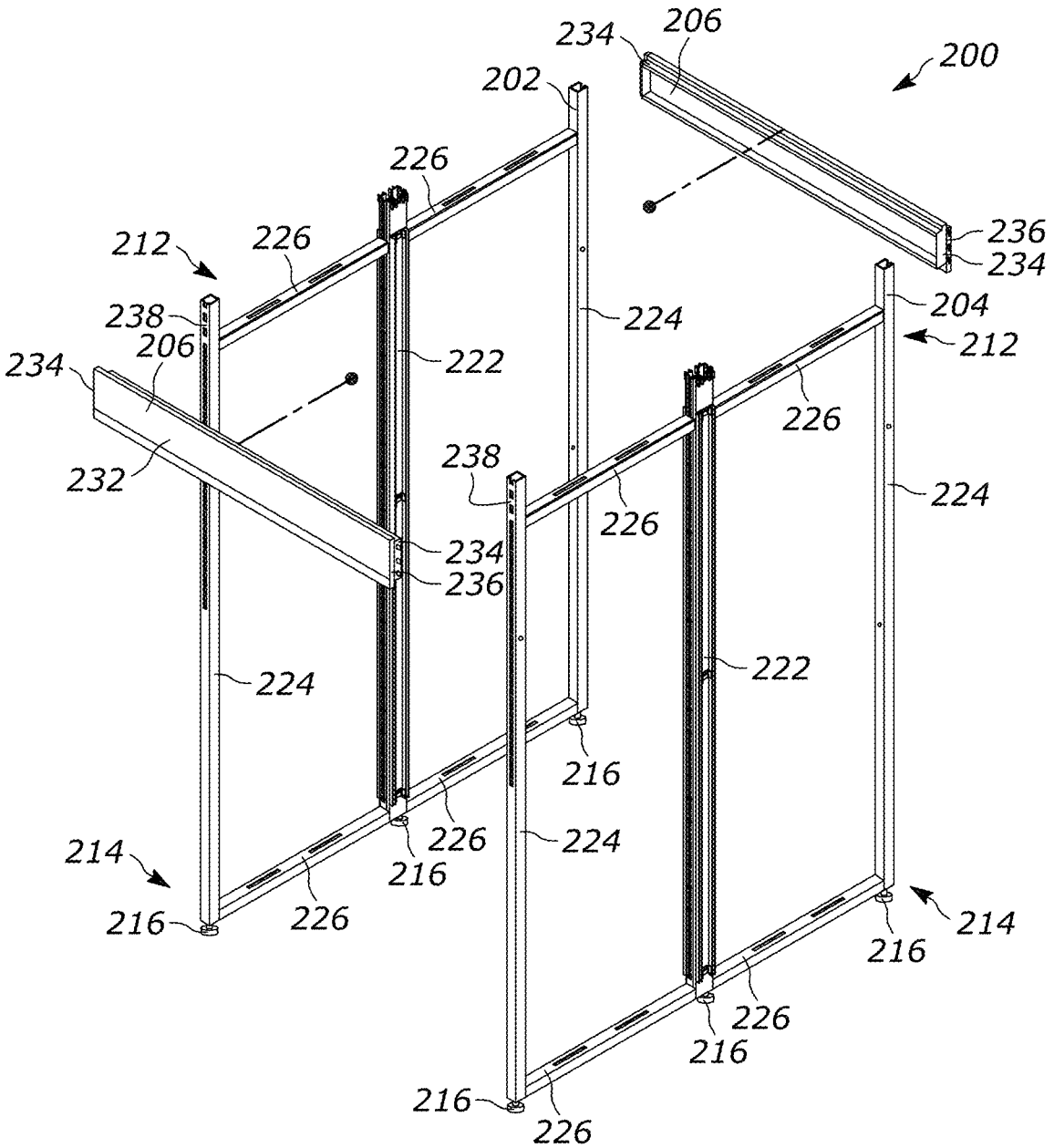
FIG. 2 is a perspective view of a partially assembled gondola shelving unit of FIG. 1 including the first and second uprights being coupled together by a front sway bar.

FIG. 2 is a perspective view of a partially assembled gondola shelving unit 200. The partially assembled gondola shelving unit 200 includes a first upright 202 and second upright 204. Illustrated in FIG. 2 is a possible first step of assembling the gondola shelving unit 102 of FIG. 1. FIG. 2 illustrates positioning the first and second uprights 202, 204 separate from one another and coupling the first and second uprights 202, 204 with front sway braces 206.

Each of the first and second uprights 202, 204 are rigid frames for the gondola shelving unit 102 of FIG. 1. The first and second uprights 202, 204 are identical, but in some examples, the first and second uprights 202, 204 could include structural differences. As illustrated in FIG. 2, the first and second uprights 202, 204 having a top end 212 and a bottom end 214 opposite the top end 212. In the present example, the bottom end 214 includes a plurality of footpads 216. In various examples, the footpads 216 are height-adjustable to stabilize and level the gondola shelving unit 102. The first and second uprights 202, 204 also have a central channel 222 and two front tubes 224 disposed opposite each other. In some examples, the first and second uprights 202, 204 include a central channel 222 and one front tube 224. The central channel 222 is parallel with the front tubes 224, but in other examples, the central channel 222 and the front tubes 224 could be angled relative to each other.

As illustrated in FIG. 2, the central channel 222 is coupled to the two front tubes 224 via horizontal struts 226. In the present example, the uprights 202, 204 are made of a rigid material capable of supporting the weight of products disposed on the shelves of the gondola shelving unit 102 and above the gondola shelving unit 102. For example, the uprights 202, 204 could be made of metal (e.g., aluminum, titanium, steel), polymers (e.g., plastic), ceramics, natural materials (e.g., wood), or any suitable combination of materials. In the present example, the central channel 222 and the front tubes 224 are secured together either because they are manufactured as a monolithic object with the horizontal struts 226 or because the horizontal struts 226 weld the central channel 222 and the two front tubes 224 to form a unitary piece.

The partially assembled gondola shelving unit 200 includes the front sway brace 206 removably coupled to the front tube 224 of the first and second uprights 202, 204 and adjacent the top end 212. The front sway brace 206 includes a front surface 232 and two coupling shoulders 234 to engage the front tubes 224. In the present example, the shoulders 234 include angled teeth 236 to engage angled slots 238 disposed on the front tube 224 adjacent the top end 212. In some examples, the teeth 236 are L-teeth to engage the slots 238, but the teeth 236 could comprise any protrusion capable of engaging an aperture in the front tube 224 and securing the front sway brace 206.

In the present example, securing the front sway brace 206 to the first and second uprights 202, 204 provides sufficient stability for the partially assembled gondola shelving unit 200. The front tube 224 includes angled slots 238 that engage and secure the teeth 236 (shown in greater detail in FIG. 3). When the teeth 236 securely engage the angled slots 238, the teeth 236 engage the slots and pull the shoulder 234 against the front tube 224. When the front sway brace 206 is secured to both the first and second uprights 202, 204, the partially assembled gondola shelving unit 200 is rigid and stable. In various examples, shelves could be coupled to the partially assembled gondola shelving unit 200 and product displayed on the shelves without further structural elements.

Figure 3:
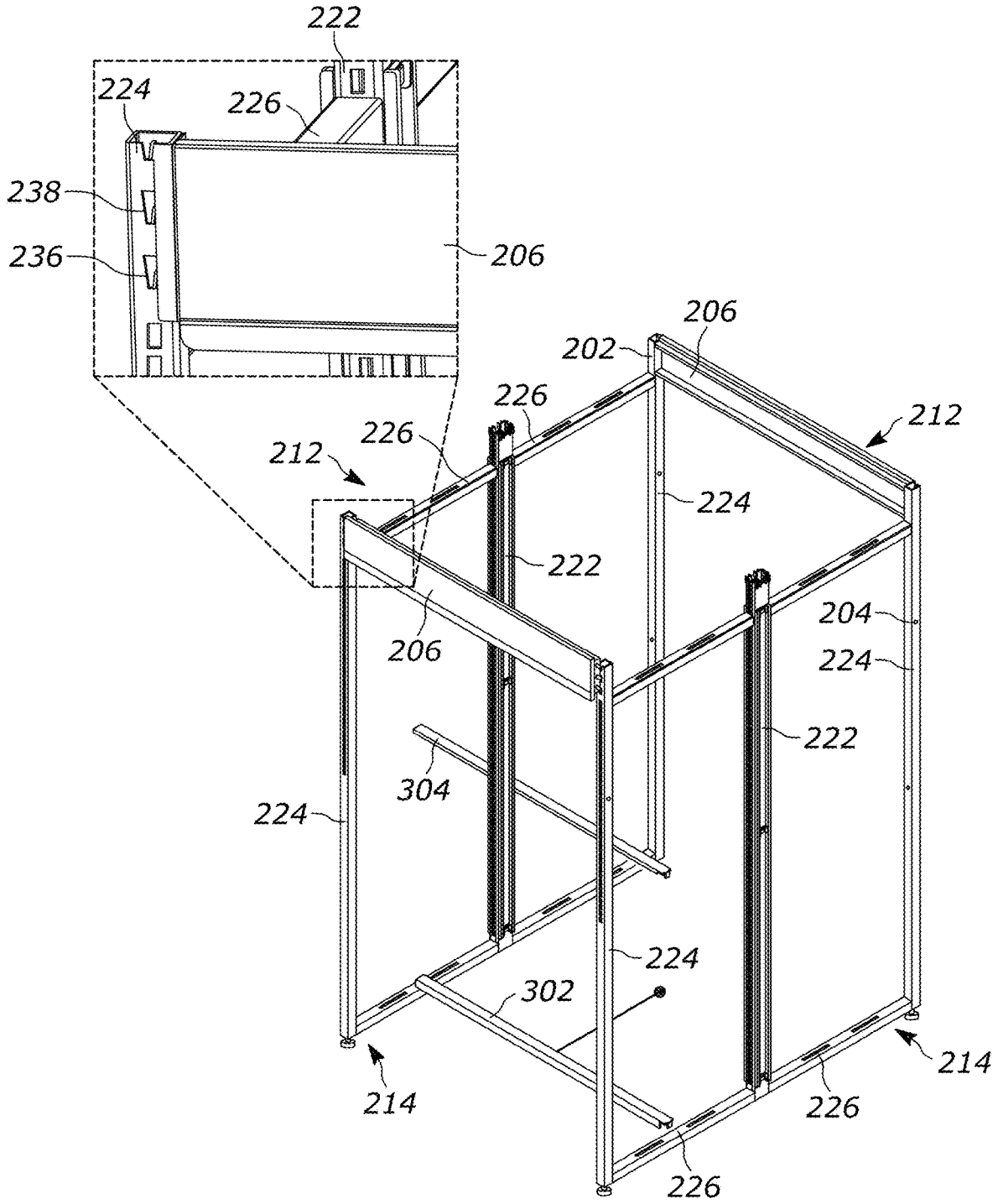
FIG. 3 is a perspective view of a partially assembled gondola shelving unit of FIG. 2 including the first and second uprights being coupled with cross braces.

FIG. 3 illustrates partially assembled gondola shelving unit 300 including the first and second uprights 202, 204 being coupled with cross braces 302, 304. Illustrated in FIG. 3 is a possible second step of assembling the gondola shelving unit 102 of FIG. 1. The second step can include coupling the first and second uprights 202, 204 with cross braces 302, 304.

The cross brace 302 is removably coupled to the central channel 222 adjacent a bottom end 214 of the uprights 202, 204. Similarly, the cross brace 304 is removably coupled to the central channel 222 at a position centrally disposed between the top end 212 and the bottom end 214. In the present example, the cross braces 302, 304 engage a bracket 402 (illustrated in FIG. 4) disposed on the central channel 222. The cross braces 302, 304 may provide additional structural support to the partially assembled gondola shelving unit 300 and prevent the assembled gondola shelving unit 102 from buckling under weight or falling out of square. However, in the present example, the front sway brace 206 provides all necessary rigidity to keep the gondola shelving unit 300, 102 stable and secure.

Figure 4:
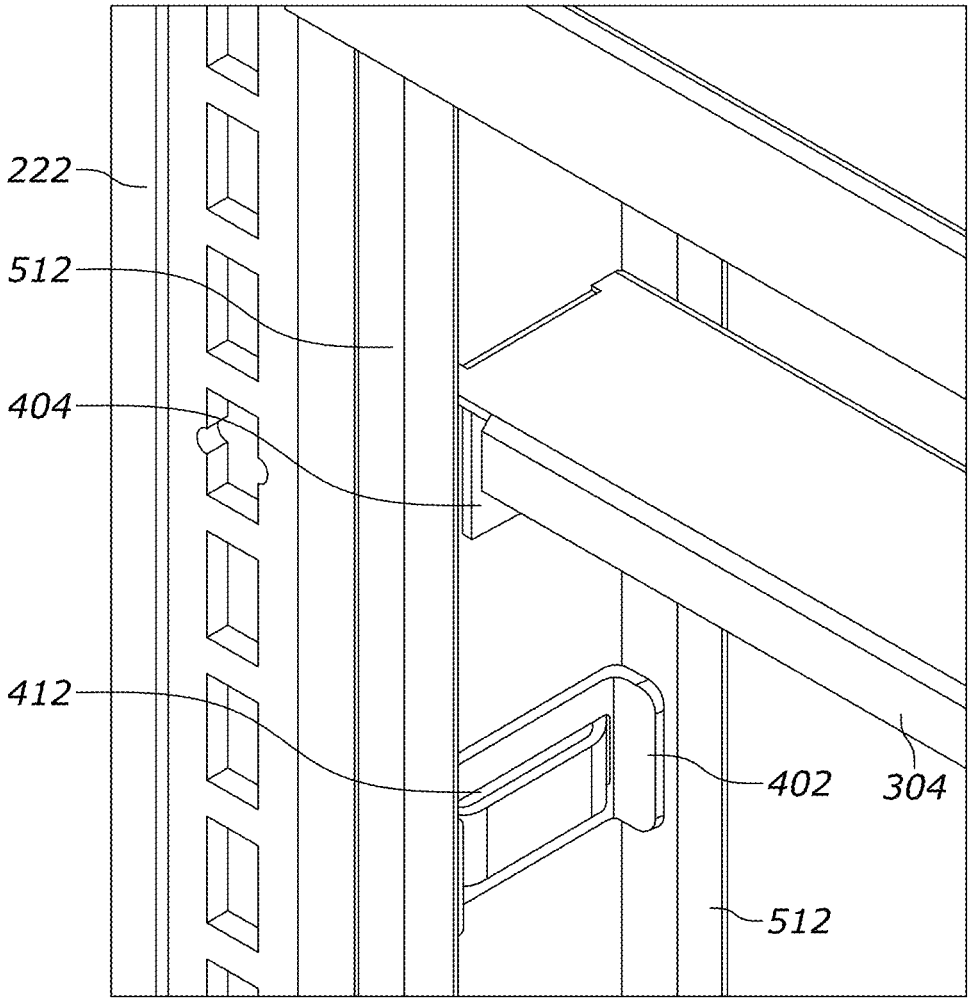
FIG. 4 is a perspective view the bracket for coupling the cross brace of FIG. 3 to one of the first and second uprights.

FIG. 4 is a perspective view the bracket 402 for coupling the cross brace 304 of FIG. 3 to one of the first and second uprights 202, 204. As shown in FIG. 4, the cross brace 304 includes a tab 404 to engage the bracket 402.

The bracket 402 includes an aperture 412 configured to receive the tab 404 of the cross brace 304. For example, as shown in FIG. 4, the tab 404 is a thin sheet, but in other examples, could be differently configured. In the present example, the bracket 402 is secured to the central channel 222 and, in various examples, may be integrally formed with the central channel 222, welded to the central channel 222, glued to the central channel 222, or secured in any other similar manner. Similarly, the tab 404 can be integrally formed with the cross brace 304 and bent into position or can be secured to the cross brace 304 in any appropriate manner. In various examples, the cross brace 303 is coupled to the first and second uprights 202, 204 in an identical or substantially similar manner.

As discussed in greater detail in connection with FIGS. 14 and 16, The central channel 222 includes a plurality of slots 432, facing the front tube 224. Each of the slots 432 are adapted to receive an L-tooth commonly used in shelving systems.

Figure 5:
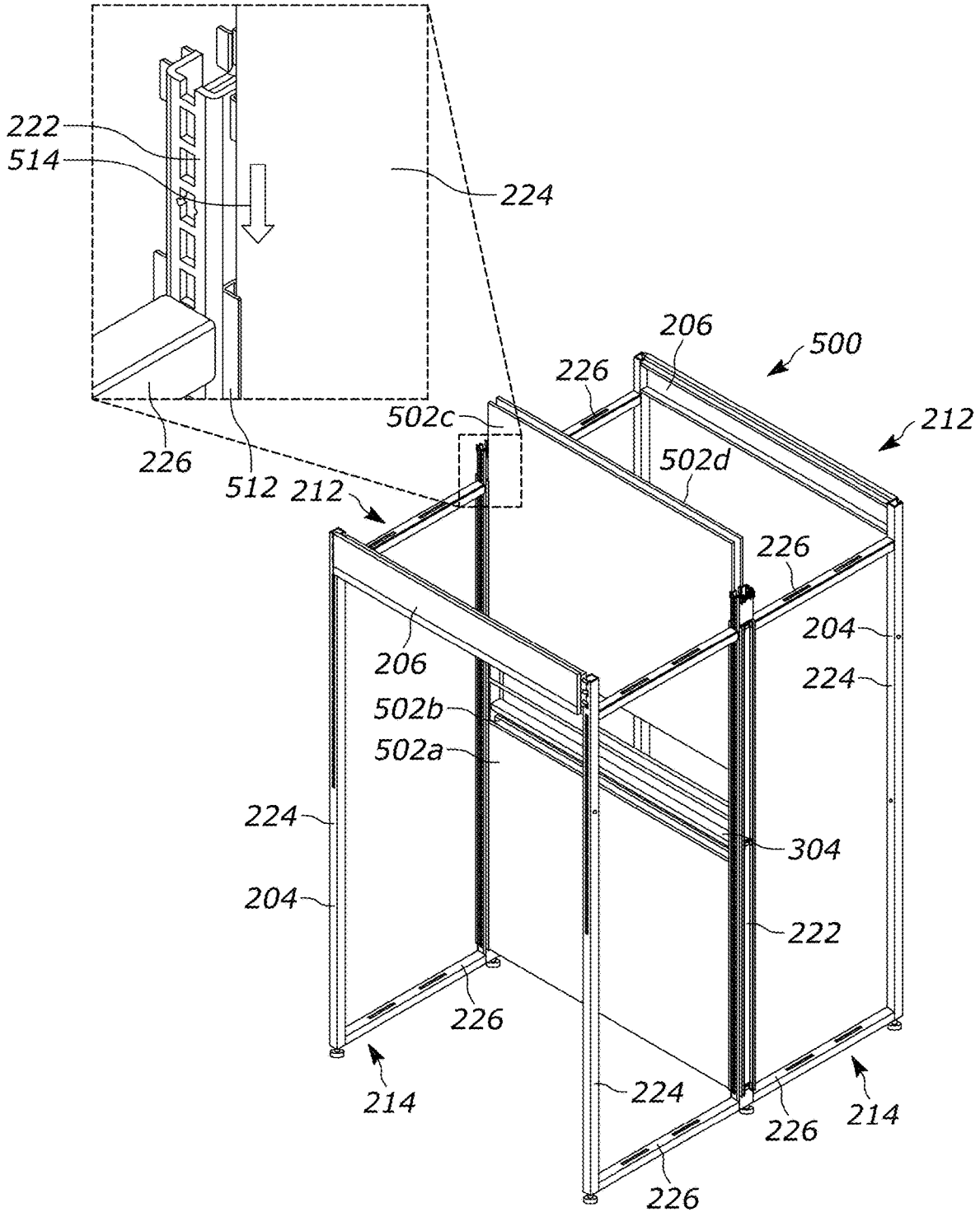
FIG. 5 is a perspective view of a partially assembled gondola shelving unit of FIG. 3 including disposing panels between the first and second uprights.
Figure 6:
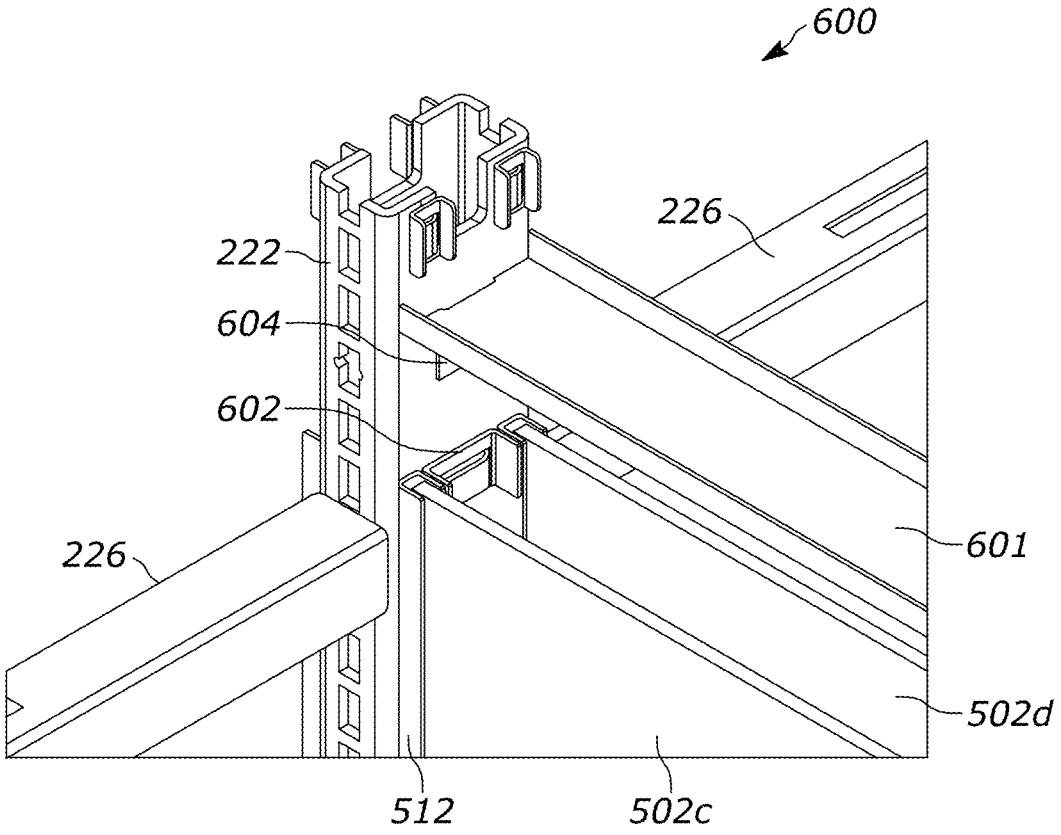
FIG. 6 is a perspective view of a partially assembled gondola shelving unit of FIG. 5 including a power supply platform coupled to one of the first and second uprights.

FIG. 5 illustrates a perspective view of a partially assembled gondola shelving unit 500 including disposing panels 502*a*, 502*b*, 502*c*, 502*d* between the first and second uprights 202, 204. As illustrated in FIG. 5, the partially assembled gondola shelving unit 500 includes four panels 502*a*, 502*b*, 502*c*, 502*d*, but in various other examples, could include more or fewer panels. The panels 502*a*, 502*b*, 502*c*, 502*d* are disposed in inwardly directed channels 512 (illustrated in greater detail in FIGS. 4 and 6). As illustrated in FIGS. 4, 5, and 6, the inwardly directed channels 512 could be U-channels, C-channels, or any similar channel capable of removably receiving the panels 502*a*, 502*b*, 502*c*, 502*d*. In some examples, the inwardly directed channels 512 are sized to hold the panel in place with friction. As shown in FIG. 5, the panel 502*c* is slid into the channel 512 and, in a similar manner, panels 502*a*, 502*b*, and 502*d* are slid into corresponding channels 512. In other examples, the panels 502*a*, 502*b*, 502*c*, and 502*d* could be removably coupled to the partially assembled gondola shelving unit 500 in other manners including clips, magnets, fasteners, etc. In various examples, the channels 512 are made of any suitable material, including metal and plastic. Illustrated in FIG. 5 is a possible third step of assembling the gondola shelving unit 102 of FIG. 1. The third step can include inserting panels 502*a*, 502*b*, 502*c*, 502*d* into corresponding inwardly directed channels 512.

In the present example, the inwardly directed channels 512 are disposed perpendicular to the slots 432 and adjacent the cross braces 302, 304 when the cross braces are coupled to the central channel 222. As a result, the panels 502*a*, 502*b*, 502*c*, 502*d* cover up the installed cross braces 302, 304. In some examples, the panels 502*a*, 502*b*, 502*c*, 502*d* assist in inhibiting the gondola shelving unit 102 from leaning out of square.

FIG. 6 is a partial perspective view of a partially assembled gondola shelving unit 600 including a horizontal platform 601 coupled to one of the first and second uprights 202, 204. The horizontal platform 601 is sized for power cords and electrical wiring and form a power supply platform. In the present example, the horizontal platform 601 is coupled to the central channel of the first and second uprights 202, 204 adjacent the top end 212. Illustrated in FIG. 6 is a possible fourth step of assembling the gondola shelving unit 102 of FIG. 1. The fourth step can include installing the horizontal platform 601 to both the first and second uprights 202, 204.

As illustrated in FIG. 6, the horizontal channel 601 is removably coupled with the first and second uprights 202, 204 in a similar manner as described in connection with the cross braces 302, 304 and shown in FIG. 4. For example, the center channel 222 may include a bracket 602 and the horizontal channel 601 includes a tab 604 configured to engage the bracket 602. In various examples, the bracket 602 and tab 604 engage each other similar to the bracket 402 and tab 404 as described in connection with FIG. 4.

Figure 7:
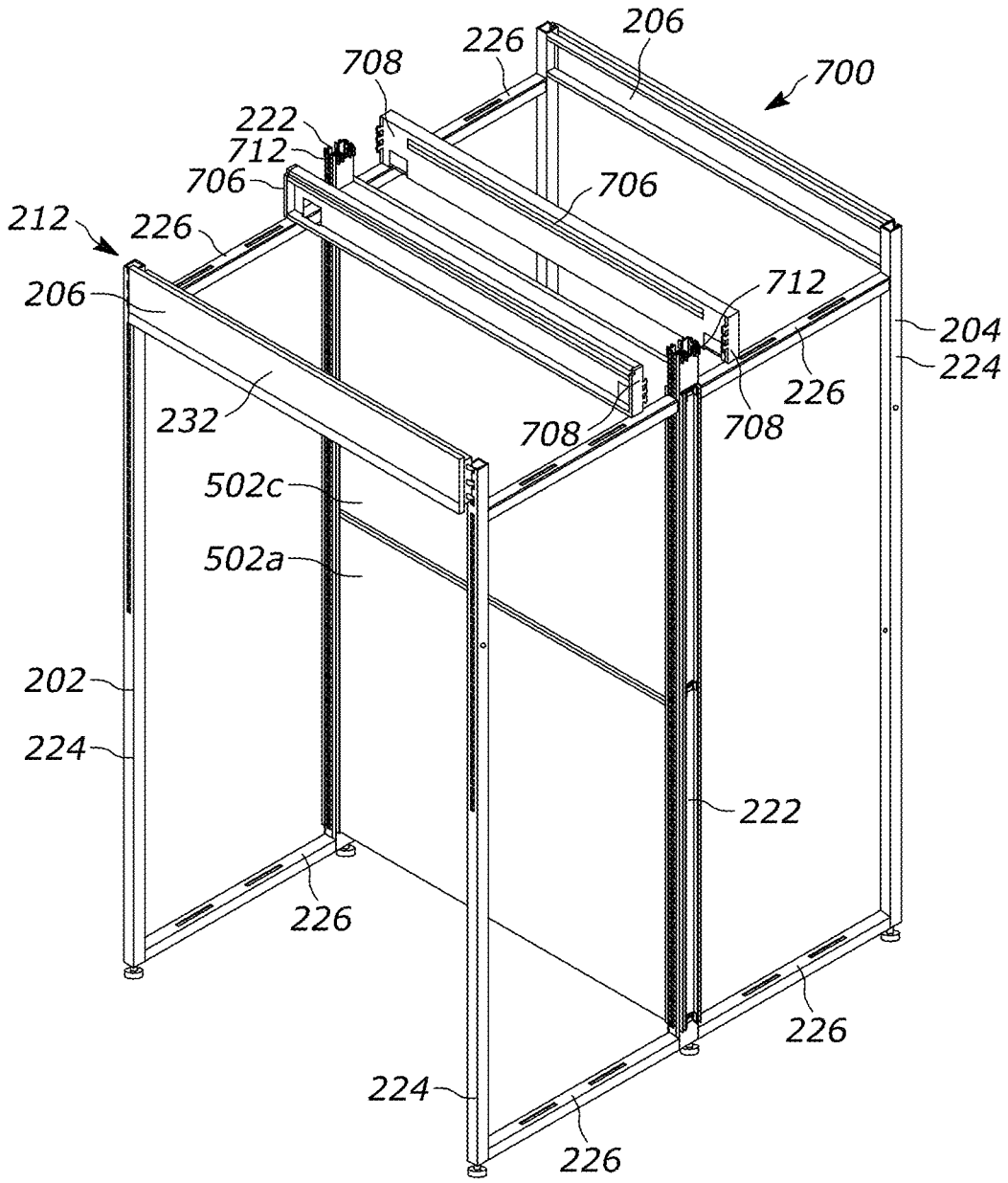
FIG. 7 is a perspective view of a partially assembled gondola shelving unit of FIG. 6 including the first and second uprights being coupled together with a back sway bar.

FIG. 7 is a perspective view of a partially assembled gondola shelving unit 700. The partially assembled gondola shelving unit 700 further includes a back sway brace 706 the first and second uprights 202, 204 being coupled together with the back sway brace 706. Illustrated in FIG. 7 is a possible fifth step of assembling the gondola shelving unit 102 of FIG. 1. The fifth step can include installing the back sway brace 706 to both the first and second uprights 202, 204.

As illustrated in FIG. 7, the back sway brace 706 is removably coupled to the central channel 222 of the first and second uprights 202, 204 and adjacent the top end 212. In the present example, the back sway brace 706 includes teeth 708 (such as L-teeth) to engage slots 712 disposed in the central channel 222. In contrast to the front sway brace 206, the teeth 708 and the slots 712 are not angled. In the present example, the back sway brace 706 is not needed to secure or stabilize the partially assembled gondola shelving unit 700 because the front sway brace 206 is already sufficiently securing the partially assembled gondola shelving unit 200, 700. However, in other examples, the central channel 222 could include angled slots and the back sway brace 706 could include angled L-teeth (similar to or in lieu of the front sway brace 206 described in connection with FIGS. 2 and 3). Accordingly, the back sway brace 706 couples to the central channel 222 in a manner similar to the front sway brace 206 coupling to the front tube 224. For example, the teeth 708 releasably engage the slots 712 to selectively secure the back sway brace 706 to the central channel 222.

Figure 8:
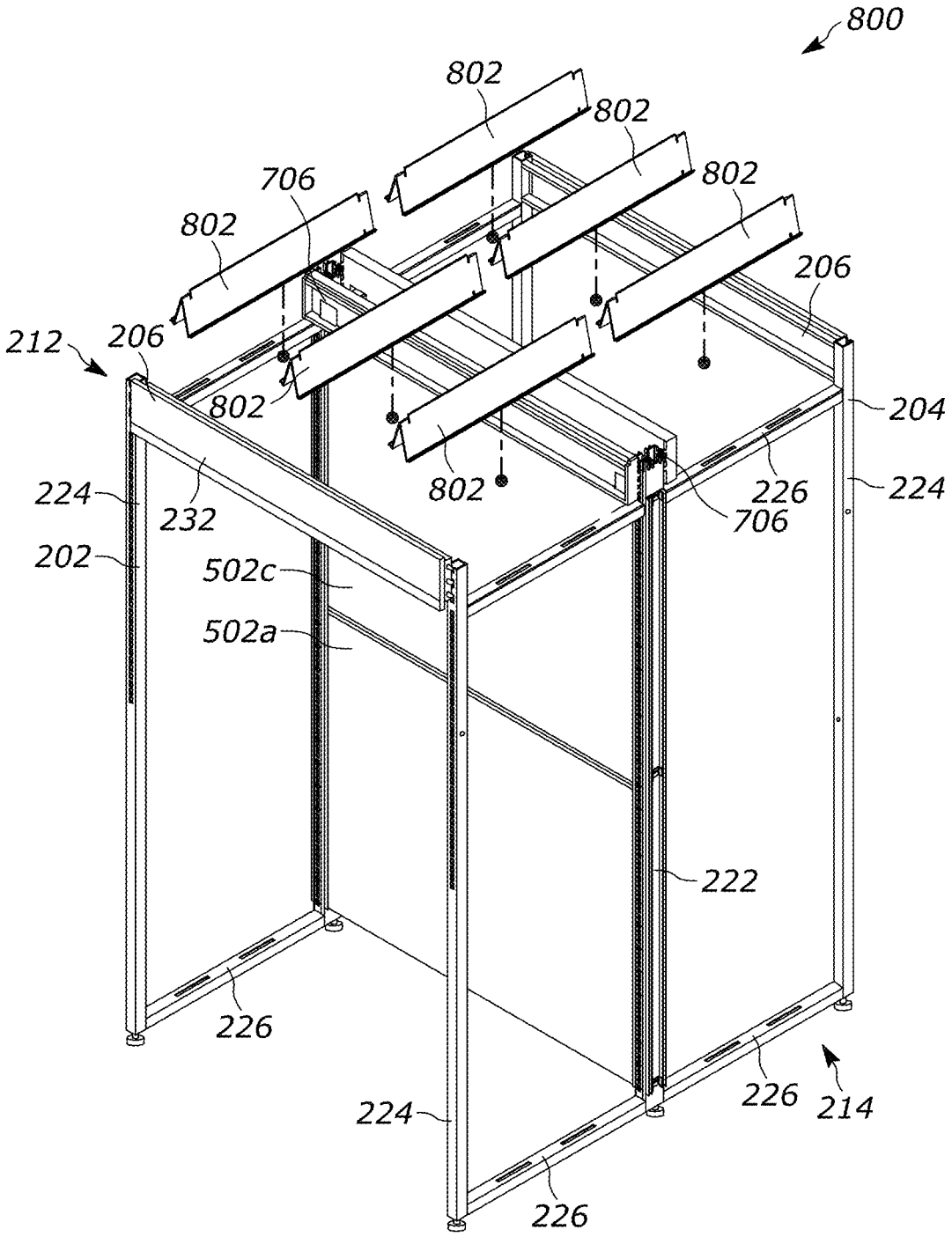
FIG. 8 is a perspective view of a partially assembled gondola shelving unit of FIG. 7 including top support panels being coupled with the front and back sway bars.
Figure 9:
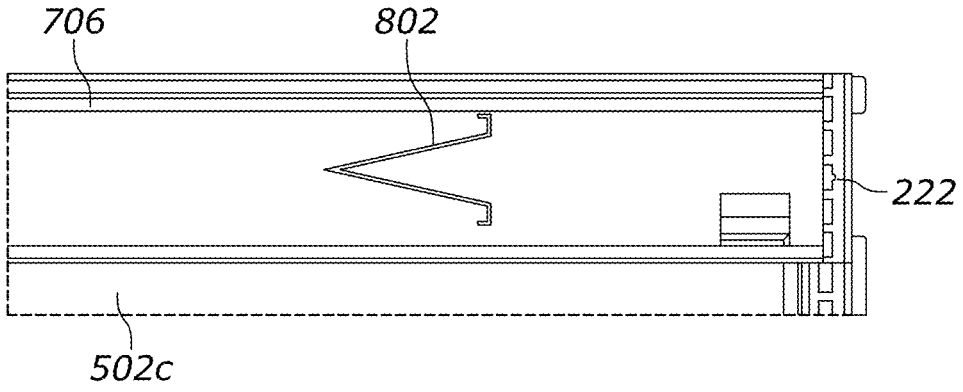
FIG. 9 is a side view the top support panel being coupled with the front and back sway bars.
Figure 10:
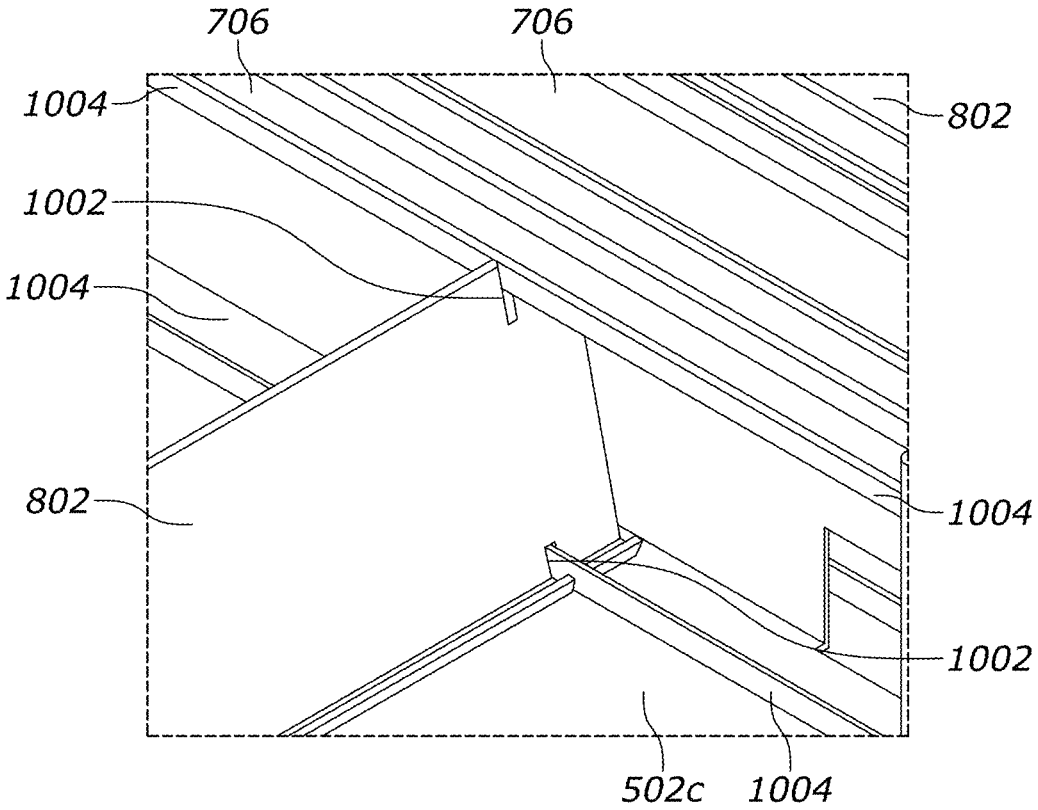
FIG. 10 is a perspective view of the top support panel coupled with one of the front and back sway bars.

FIG. 8 is a perspective view of a partially assembled gondola shelving unit 800. Illustrated in FIGS. 8, 9, and 10 is a possible sixth step of assembling the gondola shelving unit 102. The sixth step includes removably coupling top panel supports 802 to the front and back sway braces 206, 706. In the present example, the gondola shelving unit 102 includes two sets of top panel supports 802, each set including three top panel supports 802. The top panel supports 802 are triangular structural members that provide a surface on which panels can rest (described in greater detail in connection with FIG. 17). In some examples, the top panel supports 802 can further add rigidity to the partially assembled gondola shelving unit 800, but in the present example, the front sway brace 206 provides sufficient rigidity for the partially assembled gondola shelving unit 800.

FIGS. 9 and 10 illustrate the process of installing the top panel supports 802. As illustrated in FIG. 9, the top panel support 802 is rotated 90 degrees (°) and passed between the front and back sway braces 206, 706. When the top panel support 802 is in the proper position, the top panel support 802 is rotated and engages the front and back sway braces 206, 706 via kerfs 1002 in the top panel support 802 receiving a lip 1004 disposed on the front and back sway braces 206, 706. In various other examples, the top panel supports 802 can be releasably secured with the front and back sway braces 206, 706 in various other manners. For example, the top panel supports 802 can engage brackets on the front and back sway braces, similar to the cross braces 302, 304.

Figure 11:
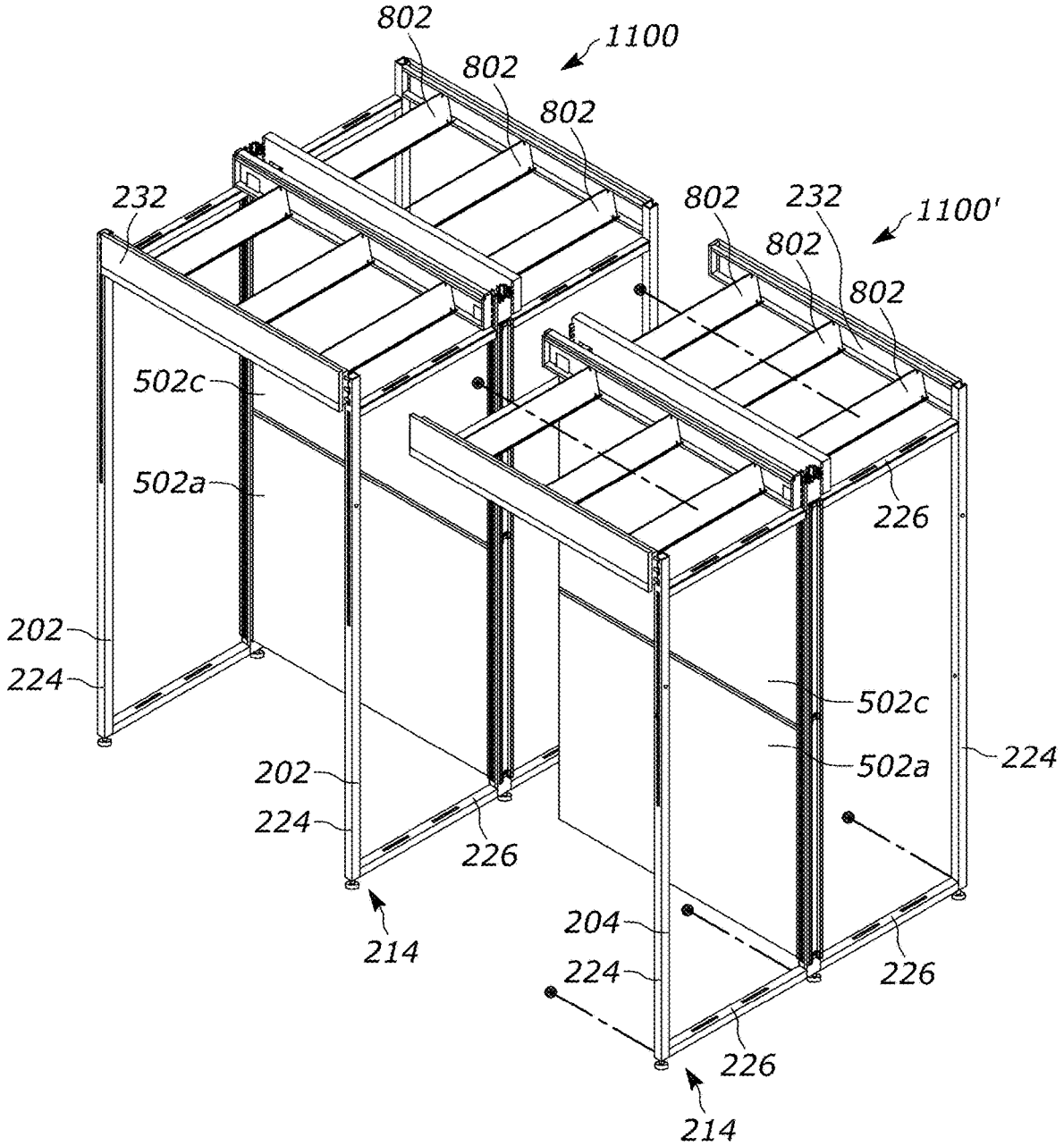
FIG. 11 is a perspective view of the gondola shelving unit of FIG. 7 expanded to incorporate another gondola shelving unit.

FIG. 11 is a perspective view of the partially assembled gondola shelving unit 1100 expanded to incorporate a partially assembled, supplementary gondola shelving unit 1100'. Illustrated in FIG. 11 is a possible seventh step in assembling the gondola shelving unit 102 of FIG. 1. In various examples, the seventh step may be omitted or repeated as many times as desired. In various examples, the gondola shelving unit 102 could be extended to be as long as approximately 40 feet, approximately 60 feet, approximately 80 feet, approximately 100 feet, or more feet. As shown in FIG. 11, the supplementary gondola shelving unit 1100' is attached to the partially assembled gondola shelving unit 1100 as an assembled unit. Alternatively, the supplementary gondola shelving unit 1100' can be assembled following the foregoing first through sixth steps already described in connection with FIGS. 2-10. As shown in FIG. 11, the supplementary gondola shelving unit 1100' includes substantially identical components as the partially assembled gondola shelving unit 1100 and, as a result, similar components are identified with the same reference numbers.

Figure 12:
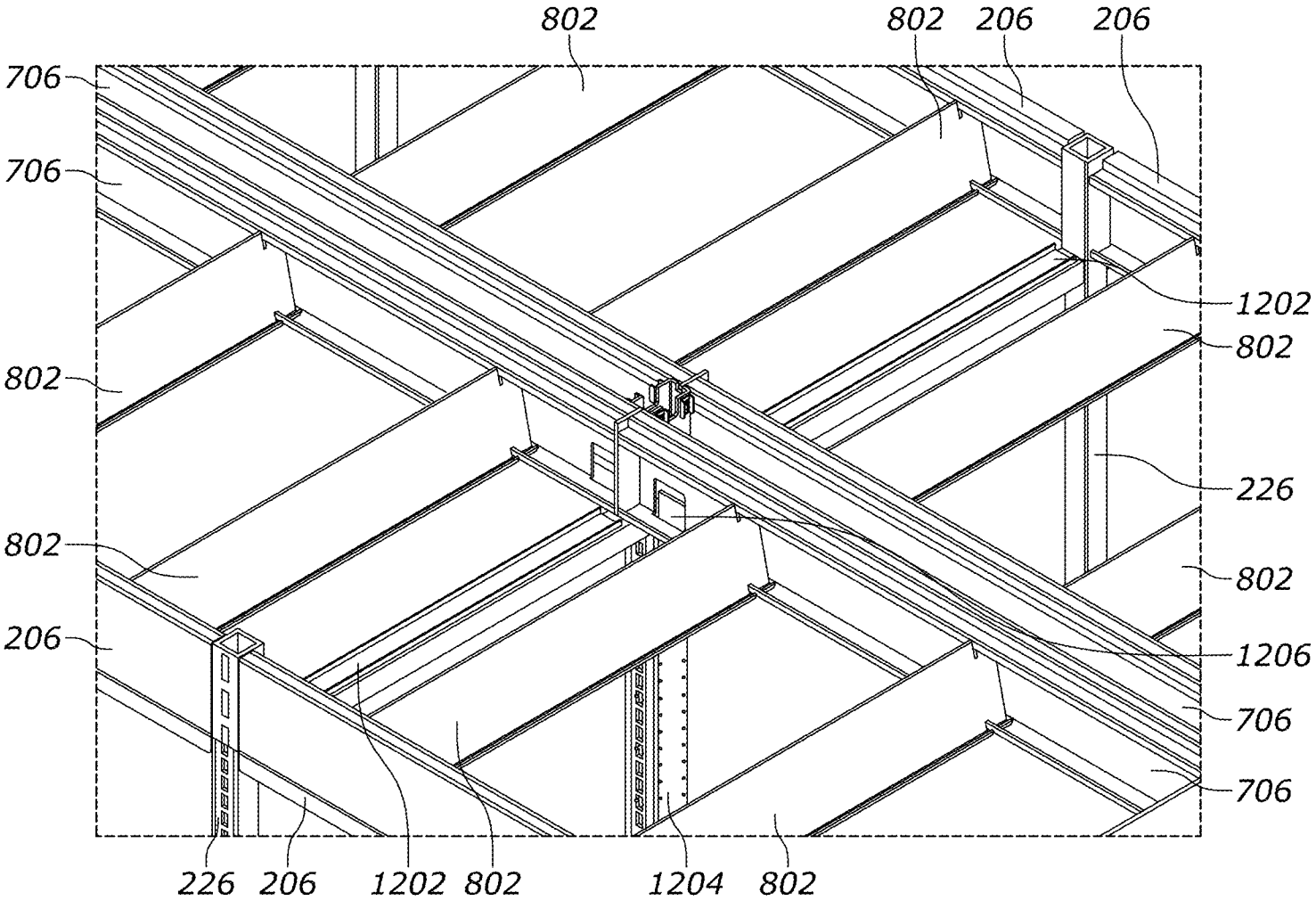
FIG. 12 is a perspective view of the gondola shelving unit of FIG. 11 including electrical and lighting channels to the first and second uprights of FIG. 1.

FIG. 12 is a perspective view of the partially assembled gondola shelving unit 1200. Illustrated in FIG. 12 is an eighth step includes attaching electrical and lighting channels to at least one of the first and second uprights 202, 204. In the illustrated example, the partially assembled gondola shelving unit 1200 includes both horizontal channels 1202 and vertical channels 1204. Additionally, as shown in FIG. 12, the back sway brace 706 includes an aperture 1206 through which, electrical cables and wiring can pass through. As a result, the combination of the vertical channels 1204, the horizontal platform 601, and the horizontal channels 1202 facilitate providing electrical wires throughout the assembled gondola shelving unit 102 of FIG. 1.

Figure 13:
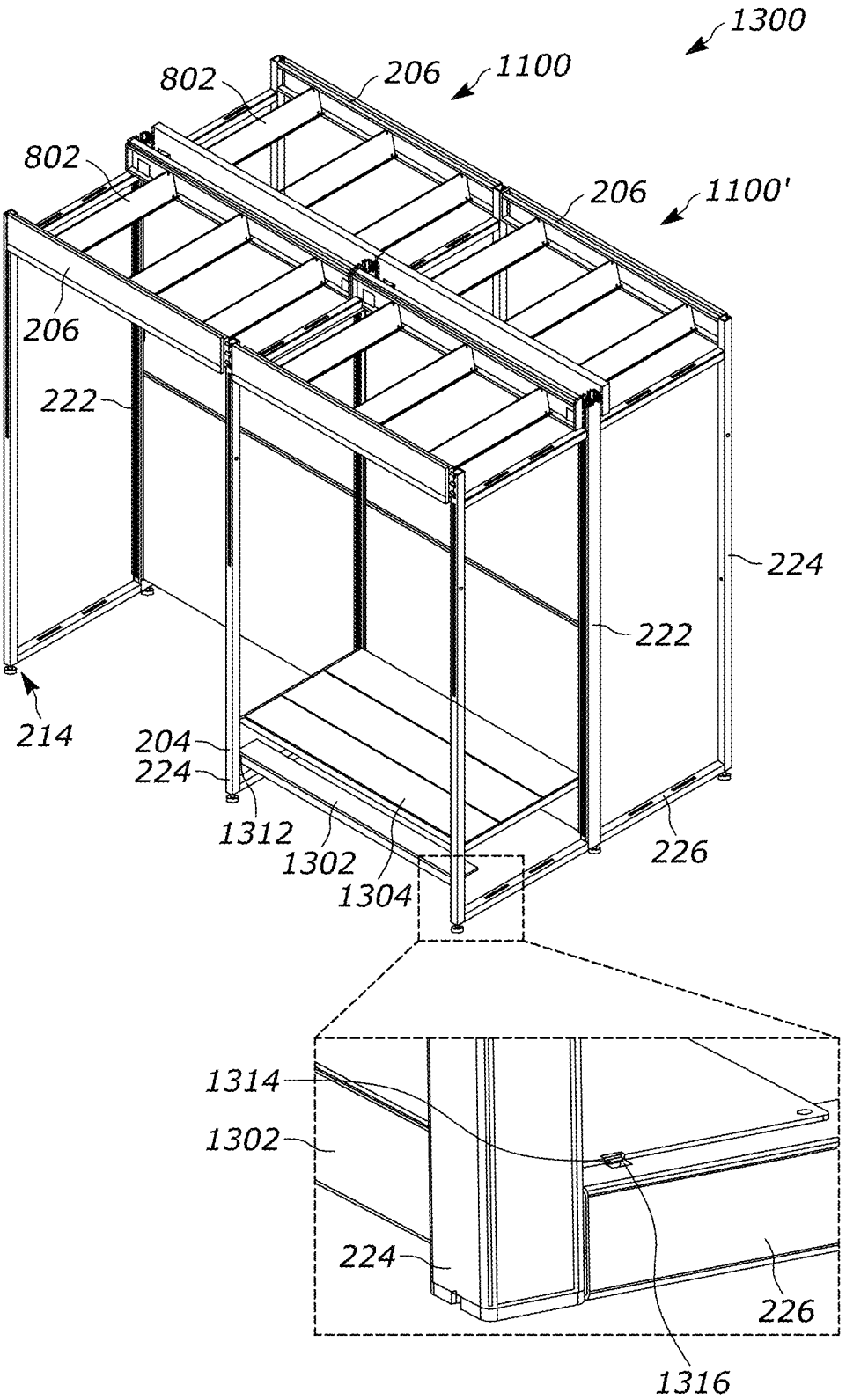
FIG. 13 is a perspective view of the gondola shelving unit of FIG. 12 including a foot cover and base shelf.

FIG. 13 is a perspective view of the partially assembled gondola shelving unit 1300. Illustrated in FIG. 13 is a ninth step of assembling the gondola shelving unit 120 of FIG. 1. As illustrated in FIG. 13, a toe-kick 1302 and a base shelf 1304 are removably coupled to the horizontal struts 226. In the present example, the toe-kick 1302 and the base shelf 1304 provide additional stability to the partially assembled gondola shelving unit 1300.

In the present example, the toe-kick 1302 and the base shelf 1304 are coupled to the horizontal struts 226. For example, the toe-kick 1302 includes an end surface 1312 and a tab 1314 to engage the horizontal struts 226 and the front tube 224 (shown in greater detail in the assembled close-up in FIG. 13). In the present example, the tab 1314 loosely engages a slot 1316 in the horizontal struts 226 while the end surface 1312 is spaced apart from the tab to removably secure the toe-kick 1302 to the struts 226. Specifically, the distance between the tab and the end surface 1312 are spaced apart such that the tab 1314 disposed in the slot 1316 on the horizontal strut 226 will cause the end surface 1312 to engage the front tube 224. Additionally or alternatively, the base shelf 1304 also engages and is removably coupled with the horizontal struts 226 and, in some examples, additionally engages the central channel 222. In various examples, the base shelf 1304 may include tabs and engage the horizontal strut (similar to the toe-kick 1302) or may include a tensioned bracket to engage slots disposed in the horizontal strut 226. The tensioned bracket is described in greater detail in connection with FIG. 15. Further, the base shelf 1304 can include teeth to engage slots disposed in the central channel 222. In other examples, the toe-kick 1302 and the base shelf 1304 can engage the horizontal struts 226, the front tube 224, and/or the central channel 222 to provide a shelf surface and also further stabilize the gondola shelving unit 1300.

In the present example, the toe-kick 1302 is loosely held on the partially assembled gondola shelving unit 1300. Because the toe-kick 1302 loosely engages the partially assembled gondola shelving unit 1300, if the toe-kick 1302 is struck by a pallet jack or shopping cart, the toe-kick 1302 separates from the gondola shelving unit 1300, 102. As a result, the toe-kick 1302 is not damaged and only requires minimal effort to reassemble with the gondola shelving unit 1300, 102. Typical gondola shelving systems do not allow for toe-kicks that loosely engage the shelving system and, as a result, typical toe-kicks would not readily disconnect from the shelving system and instead, could be dented and damaged.

Figure 14:
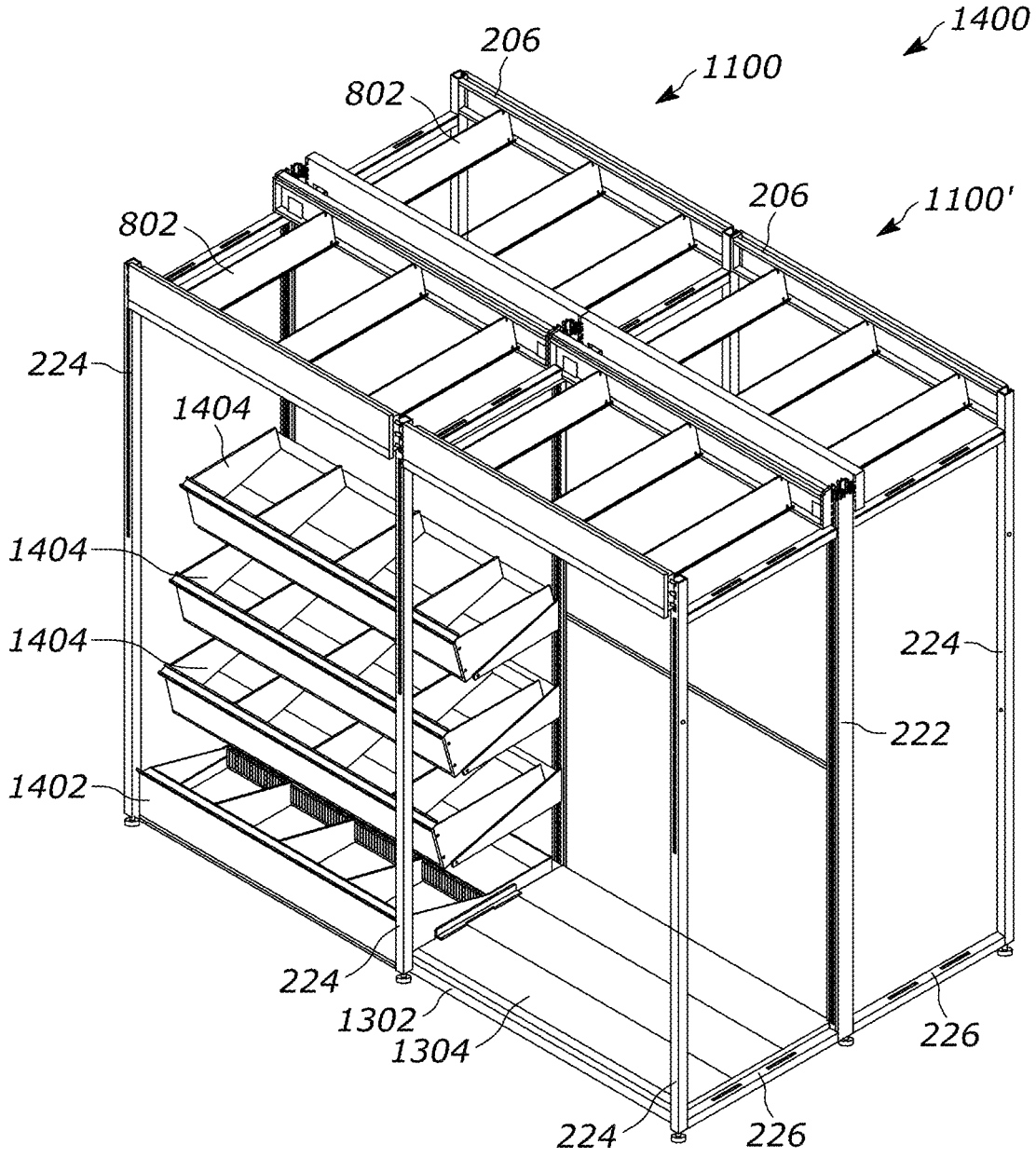
FIG. 14 is a perspective view of the gondola shelving unit of FIG. 13 including a plurality of shelves.

FIG. 14 is a perspective view of a partially assembled gondola shelving unit 1400. Illustrated in FIG. 14 is an alternative ninth step and is interchangeable with the ninth step shown in FIG. 13. For example, as illustrated in FIG. 14, a shelf 1402 is removably coupled with the front tube 224 and the central channel 222. Additionally, as shown in FIG. 14, shelves 1404 are removably coupled with the central channel 222 and, in various examples, do not provide additional rigidity to the gondola shelving units 102, 1400.

Figure 15:
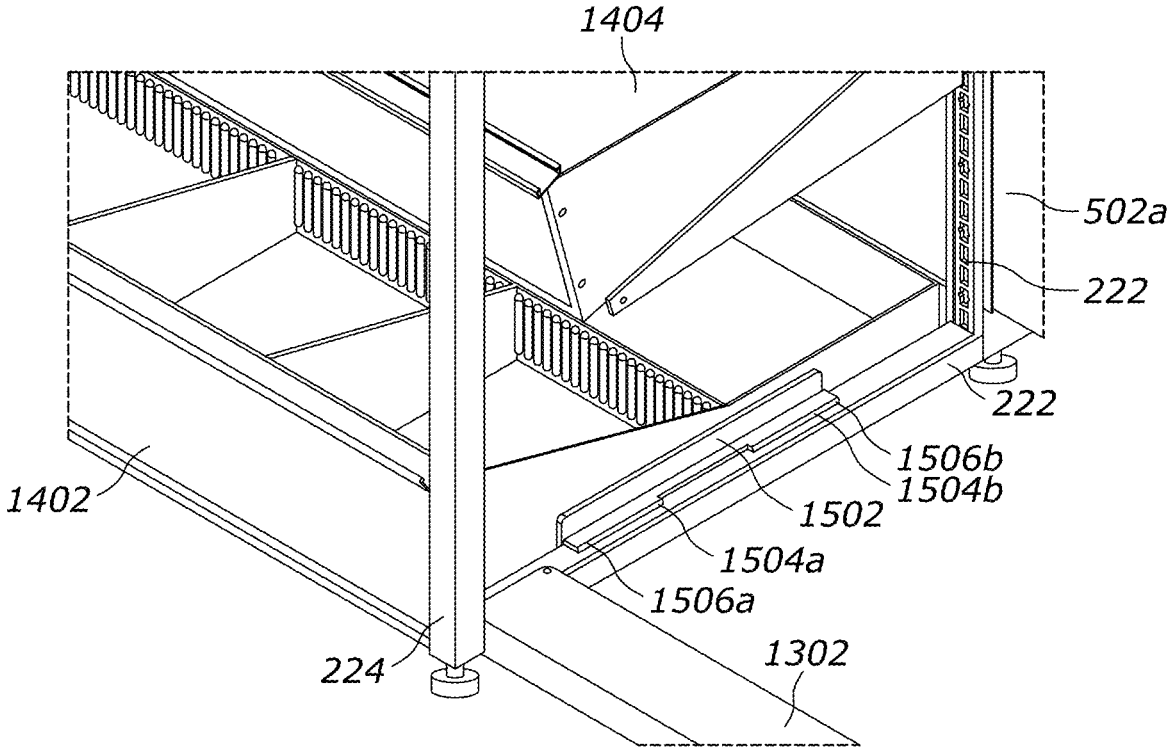
FIG. 15 is a perspective view of one of the shelves of FIG. 14 including a tensioned bracket.

FIG. 15 is a perspective view of the shelf 1402 of FIG. 14 including a tensioned bracket 1502. As shown in FIG. 15, the tensioned bracket 1502 includes a first and second tab 1504*a*, 1504*b* engaging a first and second slot 1506*a*, 1506*b*, respectively. In the present example, the tensioned bracket centers the shelf 1402 on the strut 226 and quickly aligns the shelf 1402 with the front tube 224 and the central channel 222.

Additionally, the tensioned bracket secures the shelf 1402 into gondola shelving unit 1400. The tabs 1504*a*, 1504*b* engage the slots 1506*a*, 1506*b*. In the present example, the slots 1506*a*, 1506*b* are sized to receive two tabs 1504*a*, 1504*b*, each. When two tabs 1504*a*, 1504*b* are disposed in each slot 1506*a*, 1506*b*, the tabs are pressed against each other and create a locking force that secures the shelf 1402.

Figure 16:
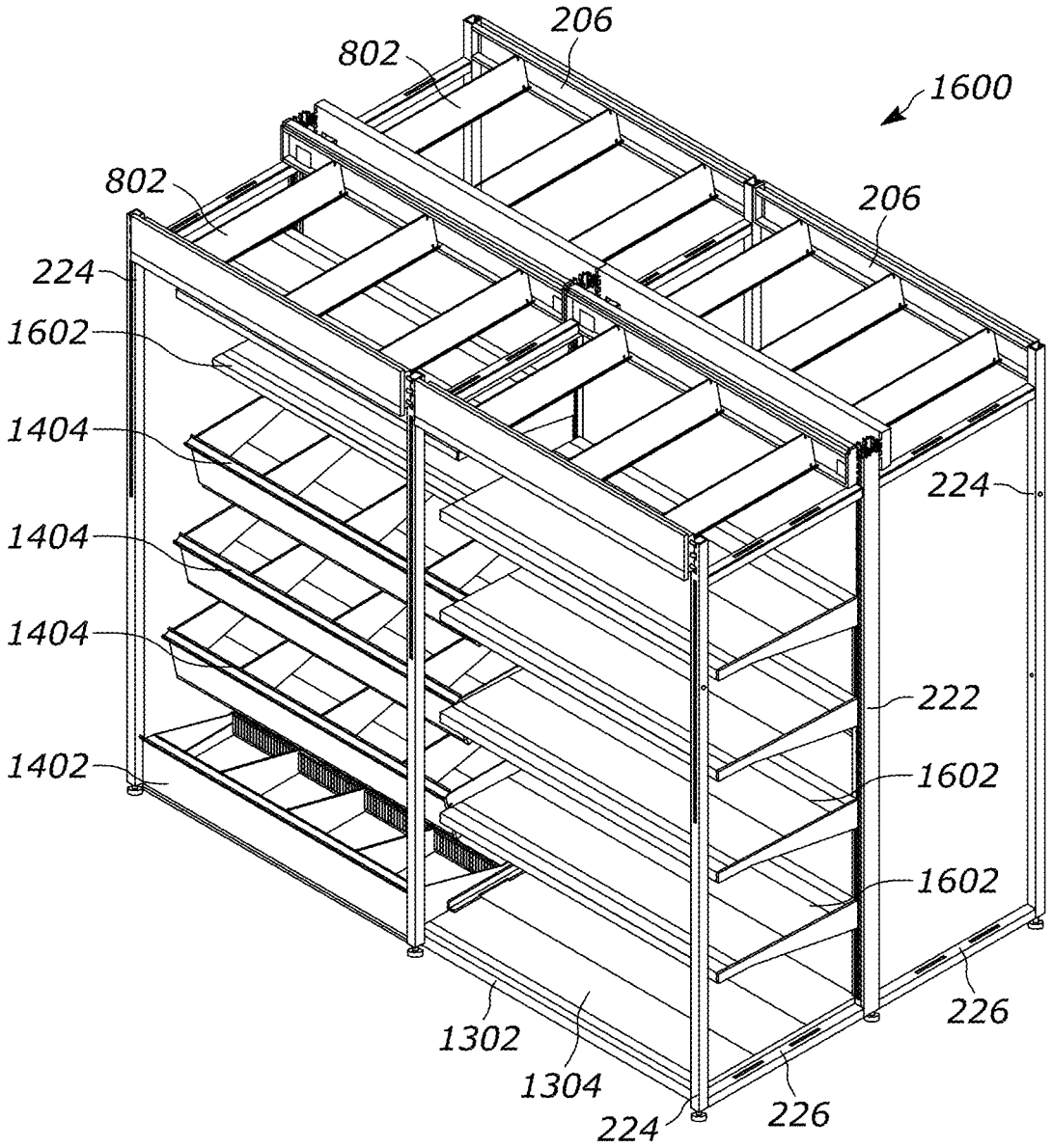
FIG. 16 is a perspective view of the gondola shelving unit of FIG. 14 further including additional shelves.

FIG. 16 is a perspective view of the partially assembled gondola shelving unit 1600 including additional shelves 1602. In the present example, the shelves 1602 provide flat horizontal surfaces to store various products. Alternatively, some of the shelves could be configured to store different items that are best stored on non-horizontal surfaces. For example, the shelves 1404 are configured for storing and presenting wine bottles.

As described herein, some of the shelves and other components include L-teeth. The L-teeth is shaped like an "L." When disposed on a shelf, the L-teeth first extend perpendicularly from the back side of the shelf and the extend parallel with the back surface of the shelf. The perpendicular and parallel portions of the L-teeth form a slit between the shelf and the parallel portion. When the L-tooth is passed into an aperture, for example, in the central channel 222, the slit engages the thickness of the material of the central channel and prevents the shelf from slipping, sagging, or falling from the central channel 222.

Figure 17:
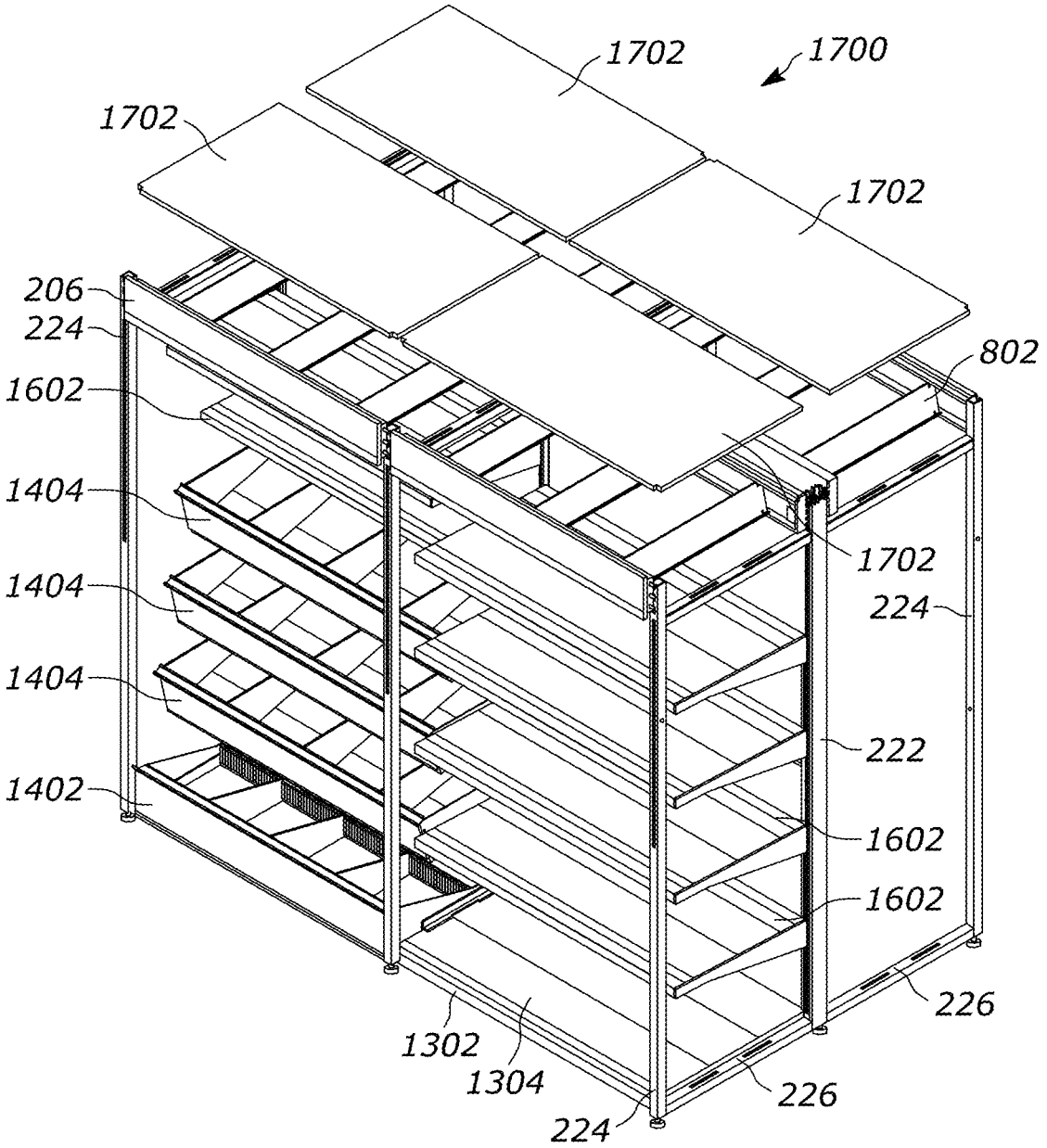
FIG. 17 is a perspective view of the gondola shelving unit of FIG. 16 including top panels.

FIG. 17 is a perspective view of the partially assembled gondola shelving unit 1700 including top panels 1702. Illustrated in FIG. 17 is a possible tenth step of assembling the gondola shelving unit 102 of FIG. 1. For example, the top shelves 1702 can be removably coupled to the front and back sway braces 206, 706 and/or the top panel supports 802. In various examples, the top panels 1702 could include clips to secure the top panel to the front and back sway braces 206, 706, could utilize fasteners, could be magnetically attached to the partially assembled gondola shelving unit 1700, and/or any other way of removably fastening the top panel 1702 to the gondola shelving unit 102. The top panel 1702 could be a plywood or plastic panel sufficient to enclose the top of the partially assembled gondola shelving unit 1700.

Figure 18:
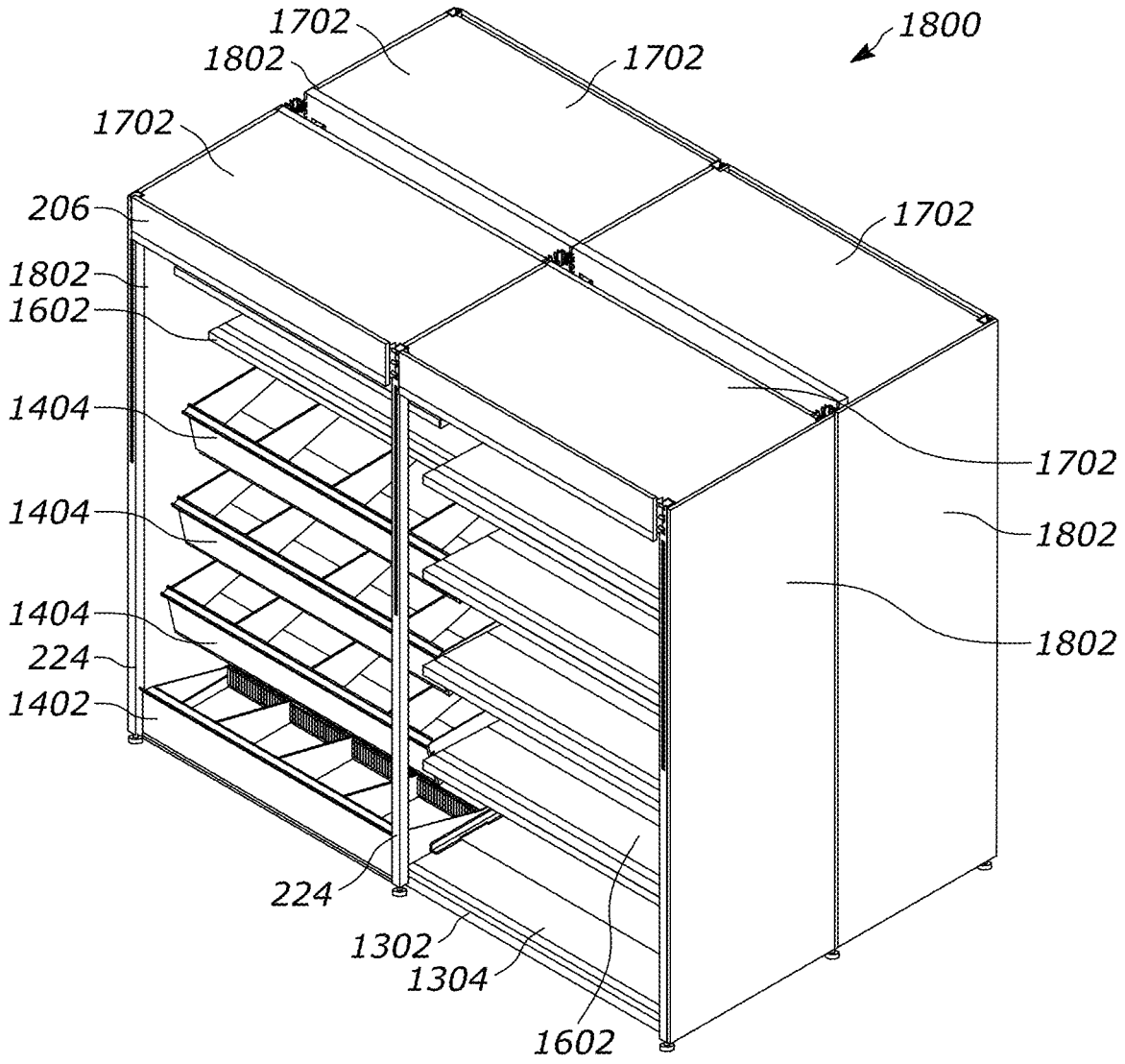
FIG. 18 is a perspective view of the gondola shelving unit of FIG. 17 including a plurality of side panels.

FIG. 18 is a perspective view of the partially assembled gondola shelving unit 1800 including a plurality of side panels 1802. Illustrated in FIG. 18 is a possible eleventh step in assembling the gondola shelving unit 102 of FIG. 1. The side panels 1802 are sized to extend from the front tube 224 and the central channel 222 and from the top panel 1702 to the horizontal struts 226. In various other examples, the side panels 1802 could be larger or smaller than the side panels 1802 shown in FIG. 18. The side panels 1802 are coupled to the partially assembled gondola shelving unit 1800 via tensioned brackets 1902 shown in FIG. 19.

Figure 19:
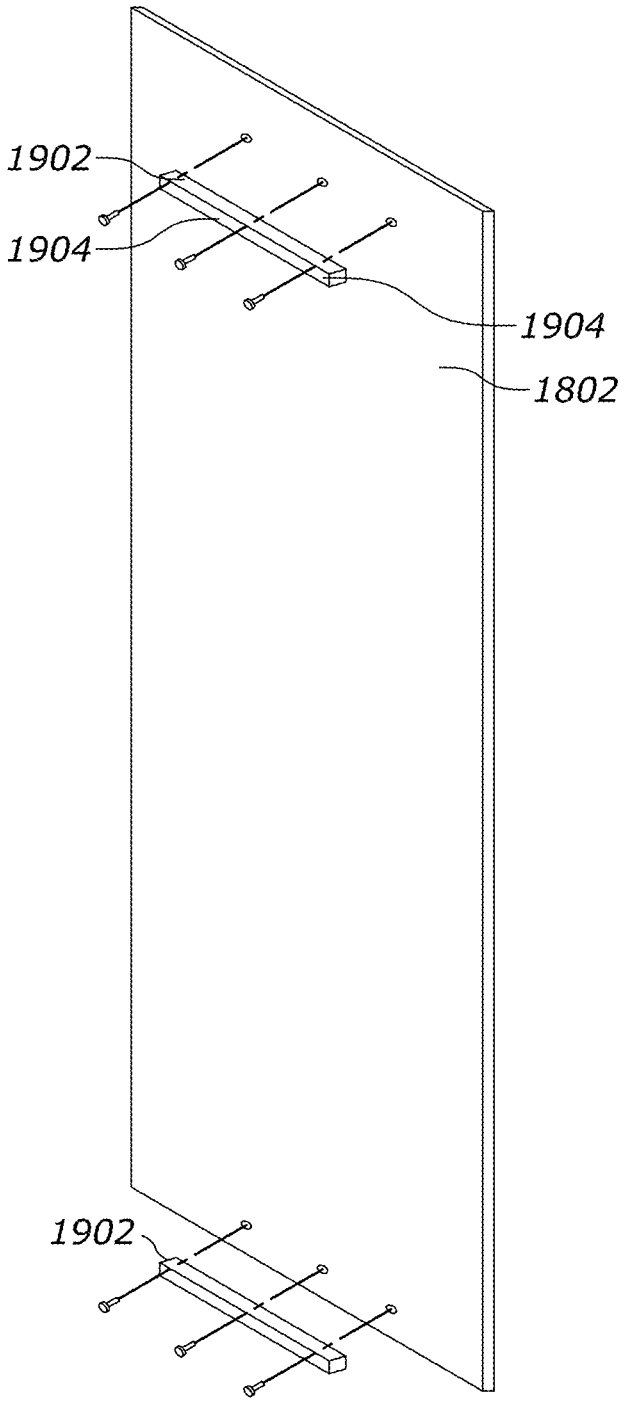
FIG. 19 is a perspective, exploded view of one of the side panels of FIG. 18 including a tensioned bracket.

FIG. 19 is a perspective, exploded view of one side panel 1802 including the tensioned bracket 1902. The tensioned bracket 1902 includes two tabs 1904 and is identical to the tensioned bracket 1502 shown and described in connection with FIG. 15. In other examples, the tensioned bracket 1902 could be slightly modified compared to the tensioned bracket 1502. For example, the tensioned bracket 1902 could include more or fewer tabs 1904 or could be differently sized.

When the side panel 1802 is coupled with one of the first and second uprights 202, 204, the tensioned brackets 1902 engage both horizontal struts 226. The tensioned brackets 1902 engage first and second slots in the horizontal struts 226. Further, in preferred examples, the tensioned brackets 1902 engage another tensioned bracket (not shown) including tabs also disposed in the slots in the horizontal struts 226. Two tensioned brackets both disposed in the same slot in the horizontal strut 226 causes a friction fit to secure the tensioned bracket to the horizontal strut 226.

Figure 20:
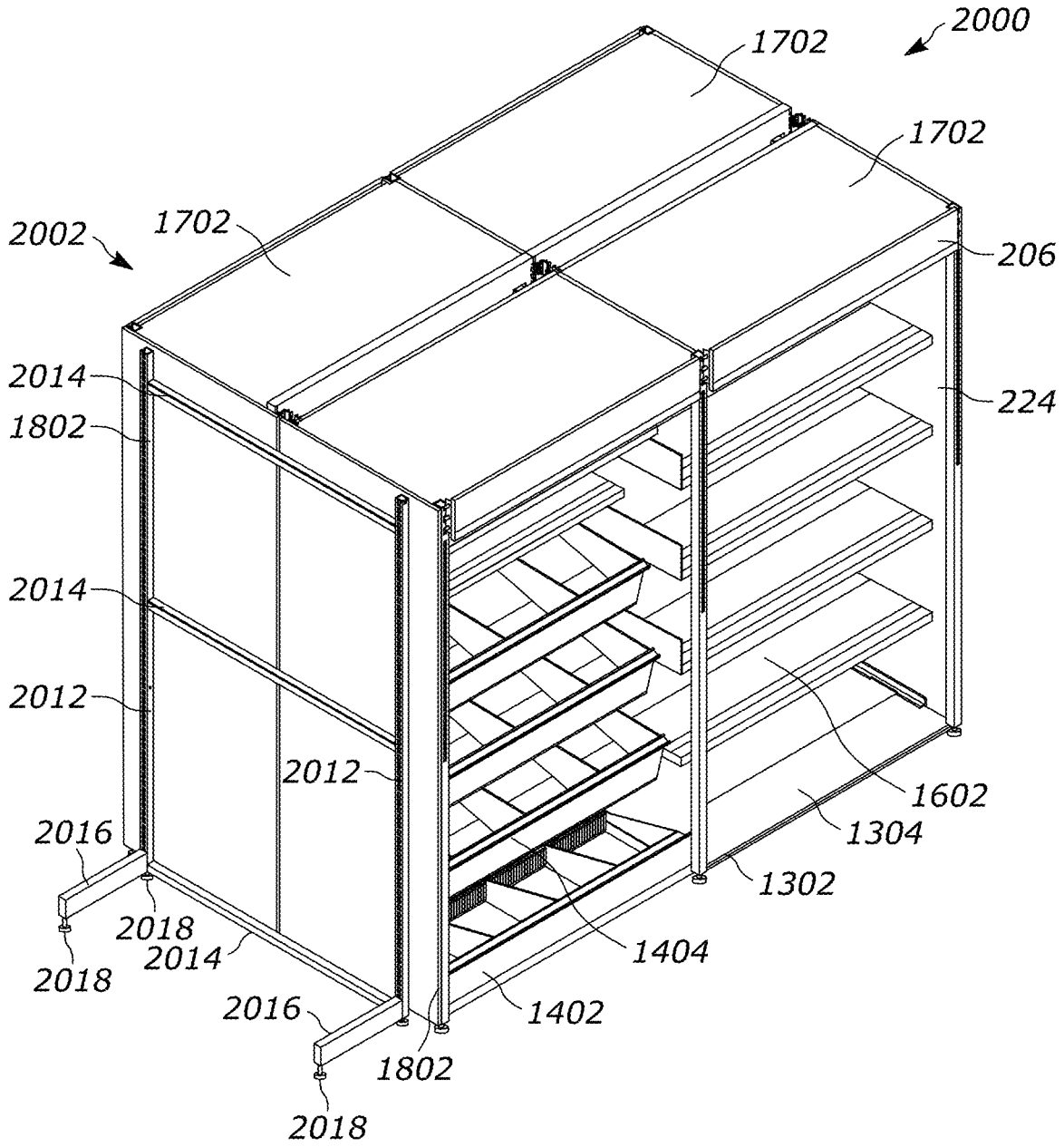
FIG. 20 is a perspective view of the gondola shelving unit of FIG. 18 including an end cap frame.

FIG. 20 is a perspective view of a partially assembled gondola shelving unit 2000 including an end cap frame 2002. Illustrated in FIG. 20 is an optional twelfth step of assembling the gondola shelving unit 102 of FIG. 1. In some examples, the end cap shelving unit 104 is not including in the gondola shelving unit 102. Alternatively, the gondola shelving unit 102 could include two end cap shelving units 104. The twelfth step includes coupling an end frame 2010.

The end cap frame 2002 includes two vertical supports 2012 and three horizontal struts 2014. The end cap frame 2002 includes two base legs 2016 and four adjustable feet 2018. In the present example, the two vertical supports 2012 are rigidly secured together via the horizontal struts 2014. Additionally, the end frame 2010 is coupled to the rest of the partially assembled gondola shelving unit 2000 via brackets (discussed in greater detail in connection with FIG. 21. Further, the base legs 2016 may be rigidly coupled to the vertical supports 2012, in some examples, the base legs 2016 include L-teeth to engage slots disposed in the vertical supports 2012.

Figure 21:
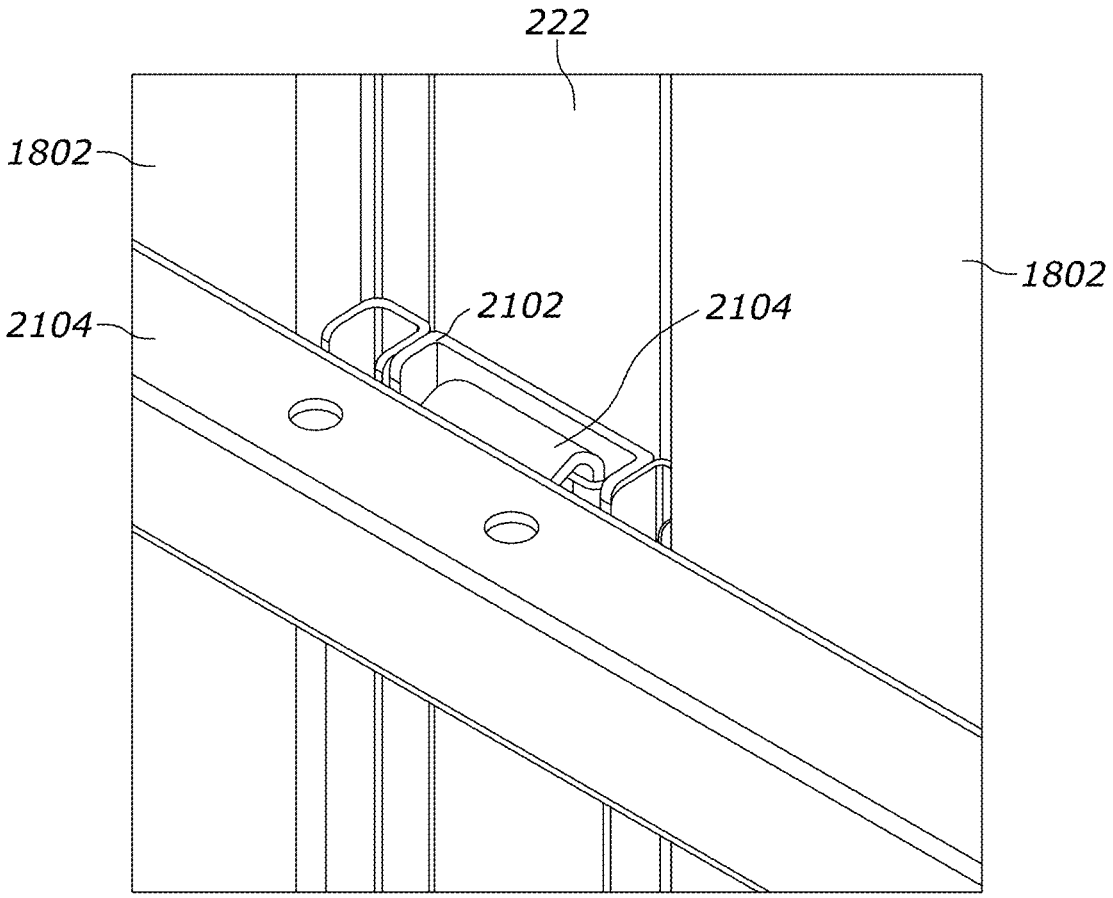
FIG. 21 is a perspective view of a bracket of the end cap frame of FIG. 20 coupling the end cap frame to the gondola shelving unit of FIG. 20.

FIG. 21 is a perspective view of a bracket 2102 of the partially assembled gondola shelving unit 2000 coupling the end cap frame 2002, via the clip 2104 on the horizontal strut 2014, to the partially assembled gondola shelving unit 2000 of FIG. 20. In various examples, the clip 2104 could rest on the bracket 2102 and/or could partially clamp onto the bracket 2102. As a result, in various examples, the end cap frame 2002 could be loosely held on or securely attached to the partially assembled gondola shelving unit 2000.

Figure 22:
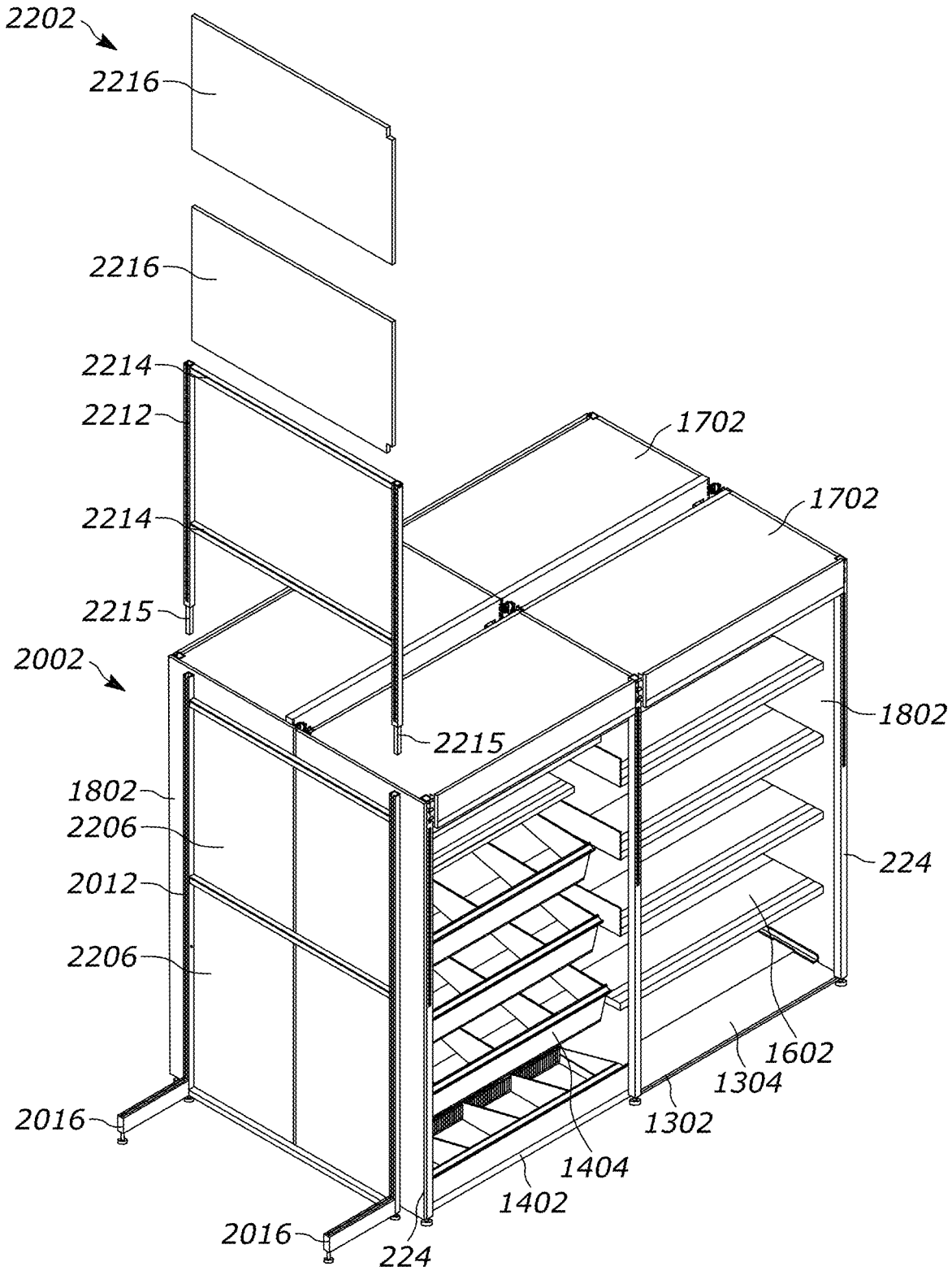
FIG. 22 is a perspective view of the gondola shelving unit of FIG. 20 including an end cap frame extension.

FIG. 22 is a perspective view of the partially assembled gondola shelving unit 2200 including an optional end cap frame extension 2202. The end cap frame extension 2202 vertically extends above the top of the top panels 1702. In some examples, the end cap frame 2002 does not include the end cap frame extension 2202 and the end cap frame 2002 is completed when panels 2206 are inserted into the end cap frame 2202.

The end cap frame extension 2202 is configured to couple to the end cap frame 2002. The end cap frame extension 2202 includes vertical supports 2212 and horizontal struts 2214. In the present example, the vertical supports 2212 and the horizontal struts 2214 are rigidly secured together. The vertical supports 2212 include a column 2215 configured to be inserted into and removably coupled to the vertical supports 2012. The length of the column 2215 is adapted to provide stability to the end cap frame extension 2202. In the present example, the end cap frame 2002 and the end cap frame extension 2202 may include U-channels to receive and secure panels 2206 and 2216

Figure 23:
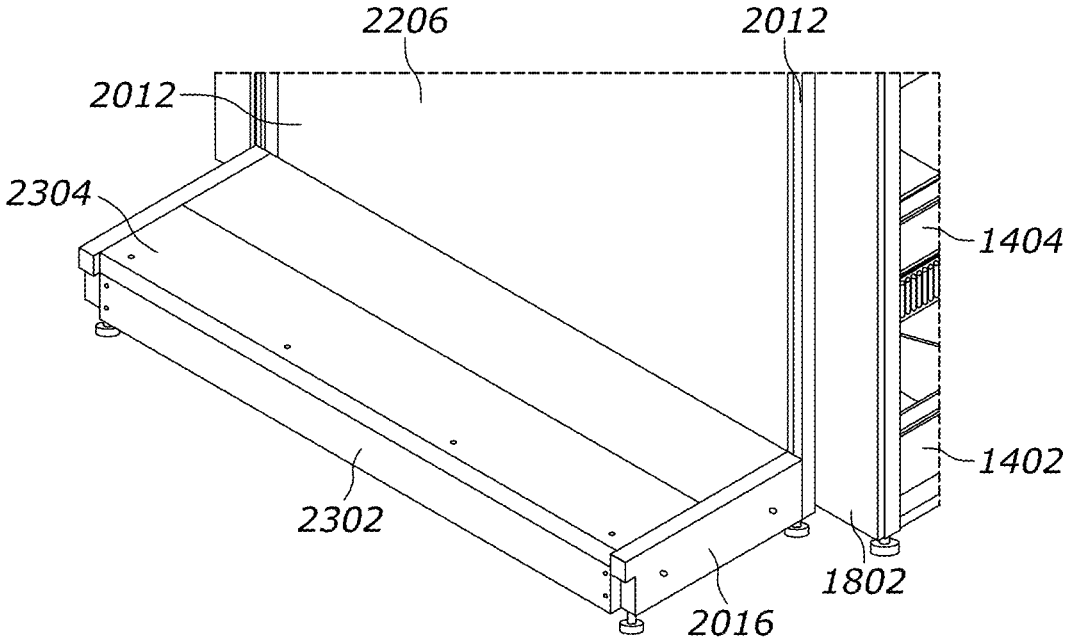
FIG. 23 is a partial perspective view of the gondola shelving unit of FIG. 22 including a foot cover and base shelf.

FIG. 23 is a partial perspective view of the gondola shelving unit of FIG. 22 including a foot cover 2302 and a base shelf 2304. FIG. 23 illustrates a possible thirteenth step in assembling the gondola shelving unit 102 of FIG. 1. In the thirteenth step, the foot cover 2302 and the base shelf 2304 stabilize and secure the end cap frame 2002. The foot cover 2303 and the base shelf 2304 prevent the end cap frame 2002 from falling out of the square. Similar to the toe-kick 1302 and the base shelf 1304 described in connection with FIG. 13, the foot cover 2302 and the base shelf 2304 may removably couple to slots disposed in the base legs 2016. In some examples, the end cap frame 2002 is finished by adding a plurality of shelves (as shown in FIG. 1). The shelves disposed on the end cap frame 2002 could be any type of shelf and coupled to the two vertical supports 2012 via, for example, L-teeth on the shelves inserted into slots in the vertical supports 2012.

Figure 24:
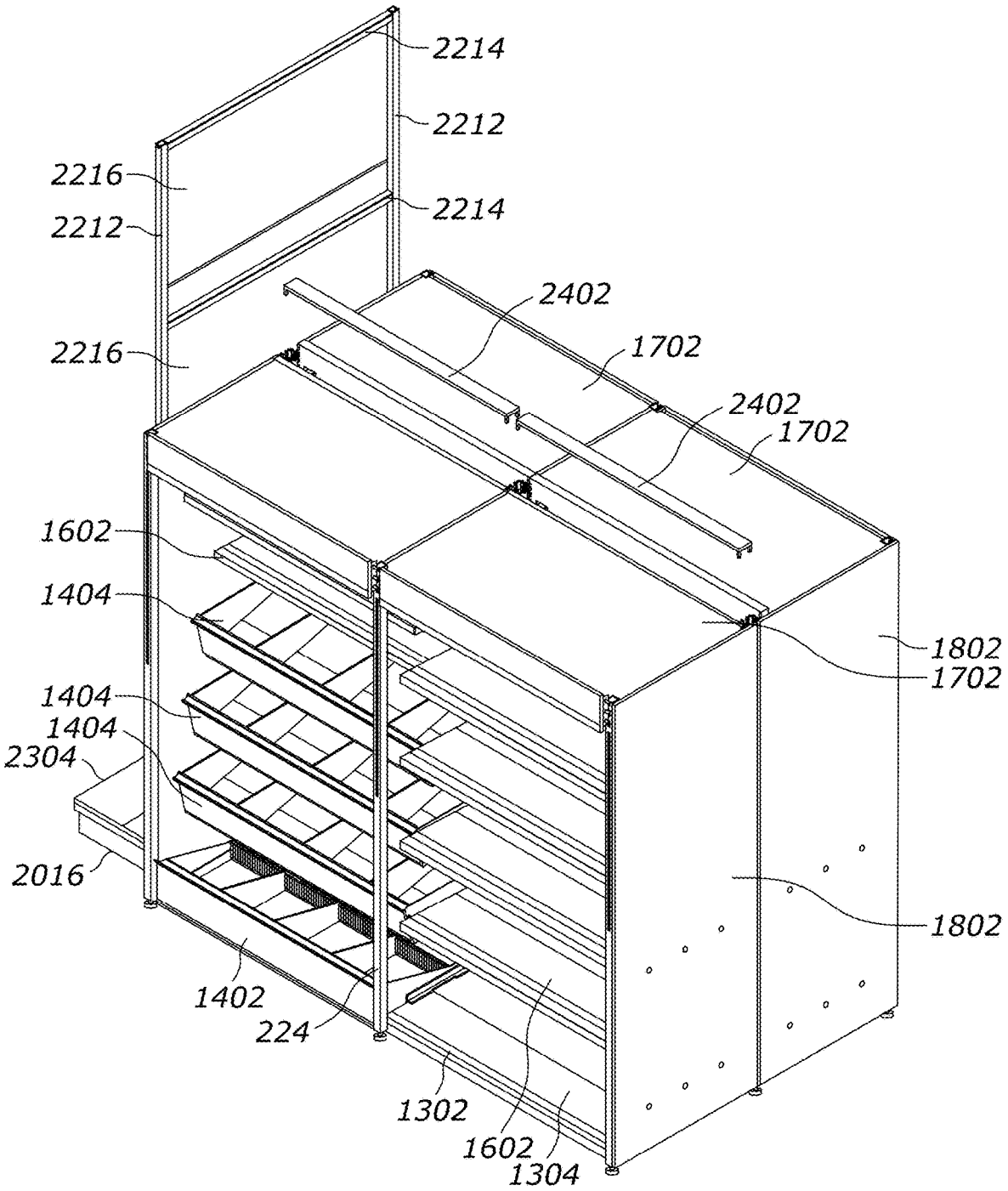
FIG. 24 is a perspective view of the gondola shelving unit of FIG. 23 including a horizontal channel cover.

FIG. 24 is a perspective view of the partially assembled gondola shelving unit 2400 including a horizontal channel cover 2402. As described herein, the horizontal channel 601 (of FIG. 6) includes the platform 601 and the horizontal channel cover 2402 enclosing the platform 601. Coupling the horizontal channel cover 2402 to the horizontal channel 601 could comprise an example fourteenth step of assembling the gondola shelving unit 102 of FIG. 1.

The horizontal channel cover 2402 covers and protects electrical wires and cords disposed on the platform 601. Accordingly, in preferred examples, coupling the horizontal channel cover 2402 to the partially assembled gondola shelving unit 2400 is a final step after confirming the electrical wiring and shelving lighting are properly installed. Further, the horizontal channel cover 2402 provides a uniform top surface to provide an additional storage surface and store products not yet displayed in the gondola shelving unit 102 of FIG. 1. In various examples, the top surface of the gondola shelving unit can store hundreds or even thousands of pounds of additional product.

In accordance with the present disclosure, the gondola shelving unit described herein provides many benefits over typical retail shelving designs. First, the gondola shelving unit is removably coupled without the use of tools to fasten the components of the gondola shelving unit together. For example, coupling the front sway brace to a first and second upright is sufficient make the gondola shelving unit rigid enough to hold and store products for sale. The first and second uprights and the front sway brace coupled together provide sufficient rigidity to the gondola shelving unit to store very large amounts of products that weight. Additionally, because the components of the gondola shelving unit couple together without the use of other fasteners, assembling the gondola shelving unit is easier than typical retail shelving assemblies. In some examples, assembling the gondola shelving unit described in accordance with the present disclosure is quicker than assembling typical gondola shelving units while including additional features such as channels for electrical and lighting accessories. Further, because the front sway brace coupled to the first and second uprights is sufficient to provide all necessary rigidity for storing large amounts of product, the toe-kick is able to loosely engage the first and second uprights. This protects the toe-kick from damage when brought into contact with a pallet jack or a shopping cart. Other shelving systems rely on the toe-kick being securely fastened together and, thereby, susceptible to damage. The foregoing benefits are described by example and do not enumerate all the benefits the presently disclosed gondola shelving unit provide over typical retail shelving assemblies.

Those skilled in the art will recognize that a wide variety of modifications, alterations, and combinations can be made with respect to the above described examples without departing from the spirit and scope of the invention(s) disclosed herein, and that such modifications, alterations, and combinations are to be viewed as being within the ambit of the inventive concept(s).

What is claimed is:

1. A gondola shelving unit, comprising:

a first upright having a first central channel, a first front tube extending in a direction parallel to the first upright, a first horizontal strut extending between the first upright and the first front tube, a second front tube extending in a direction parallel to the first upright, a second horizontal strut extending between the first upright and the second front tube, the first front tube, the first horizontal strut, the first upright, the second horizontal strut, and the second front tube are all manufactured as a monolithic piece such that the first front tube, the first horizontal strut, the first upright, the second horizontal strut, and the second front tube are rigidly secured to one another, a second upright having a first central channel, a third front tube extending in a direction parallel to the second upright, a third horizontal strut extending between the second upright and the third front tube, a fourth front tube extending in a direction parallel to the second upright, a fourth horizontal strut extending between the second upright and the fourth front tube, the third front tube, the third horizontal strut, the second upright, the fourth horizontal strut, and the fourth front tube all manufactured as a monolithic piece such that the third front tube, the third horizontal strut, the second upright, the fourth horizontal strut, and the fourth front tube are rigidly secured to one another; and a horizontal channel secured between the first central channel of the first upright and the first central channel of the second upright, the horizontal channel including a first tab at a first end thereof, the first tab being received in a bracket of the first central channel of the first upright adjacent a top of the first upright, and a second tab at a second end thereof, the second tab being received in a bracket of the second central channel of the second upright, adjacent a top of the second upright.

2. The gondola shelving of claim 1, further comprising a horizontal channel cover over the horizontal channel, the horizontal channel cover and the horizontal channel cooperating to receive one or more wires or cords therebetween in a covered and protected manner.

3. The gondola shelving unit of claim 1, wherein at least the first horizontal strut, the first upright, and the second horizontal strut are welded to one another.

* * * * *